US007748691B2

(12) United States Patent
Mizuguchi

(10) Patent No.: US 7,748,691 B2
(45) Date of Patent: Jul. 6, 2010

(54) MANUAL FEED TRAYS AND IMAGE FORMING APPARATUS

(75) Inventor: Keisuke Mizuguchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 30 days.

(21) Appl. No.: 12/361,988

(22) Filed: Jan. 29, 2009

(65) Prior Publication Data

US 2009/0267283 A1 Oct. 29, 2009

(30) Foreign Application Priority Data

Apr. 24, 2008 (JP) ..... 2008-114191

(51) Int. Cl.
*B65H 3/44* (2006.01)
*B65H 5/26* (2006.01)

(52) U.S. Cl. ..... 271/9.09; 271/162; 271/171

(58) Field of Classification Search ..... 271/9.09, 271/162, 171, 145; 400/648, 693; 399/392
See application file for complete search history.

(56) References Cited

U.S. PATENT DOCUMENTS 3,799,538 A * 3/1974 Suzuki ..... 271/162
3,827,687 A * 8/1974 Kono ..... 271/117
5,085,422 A * 2/1992 Sagara ..... 271/162
5,238,235 A * 8/1993 Nitta et al. ..... 271/9.09
5,573,235 A * 11/1996 Asai ..... 271/121
6,991,392 B2 * 1/2006 Hult et al. ..... 400/624
7,036,813 B2 * 5/2006 Asada ..... 271/117
7,062,196 B2 * 6/2006 Nanno ..... 399/107
7,302,223 B2 * 11/2007 Kawashima ..... 399/392
7,356,302 B2 * 4/2008 Yamamoto ..... 399/388
7,677,556 B2 * 3/2010 Murayama et al. ..... 271/162
2005/0062217 A1 * 3/2005 Asada ..... 271/162
2006/0157911 A1 * 7/2006 Learmonth et al. ..... 271/113
2006/0182485 A1 * 8/2006 Ogawa et al. ..... 400/647

FOREIGN PATENT DOCUMENTS

JP 05024667 A * 2/1993
JP 08-258998 10/1996
JP 2005-178992 7/2005

* cited by examiner

*Primary Examiner*—Patrick Mackey
*Assistant Examiner*—Prasad V Gokhale
(74) *Attorney, Agent, or Firm*—K&L Gates LLP

(57) ABSTRACT

A manual feed tray including a cover member pivotally supported at a lower end and assuming a storage position and a sheet feeding position; a sheet feeding platform situated at the lower end side of the cover member in the sheet feeding position, and mounted to the cover member so as to be capable of sliding toward the upper end side of the cover member and so as to leave a gap between the sheet feeding platform and itself; and an extension member assuming a storage position in which the extension member is stored in the gap between the sheet feeding table and the cover member and a pulled-out position.

20 Claims, 21 Drawing Sheets

【FIG.1】
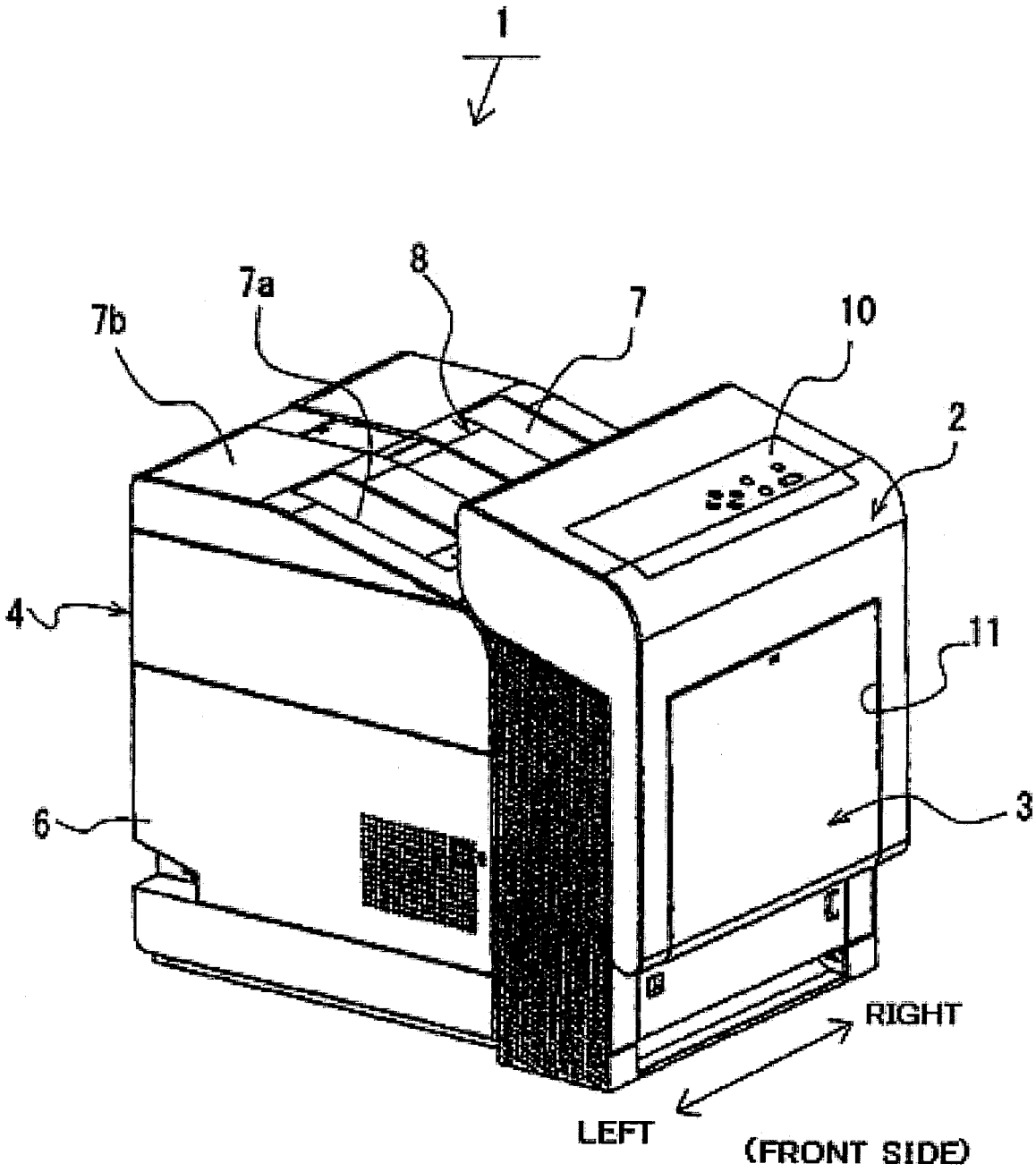

[FIG.2]
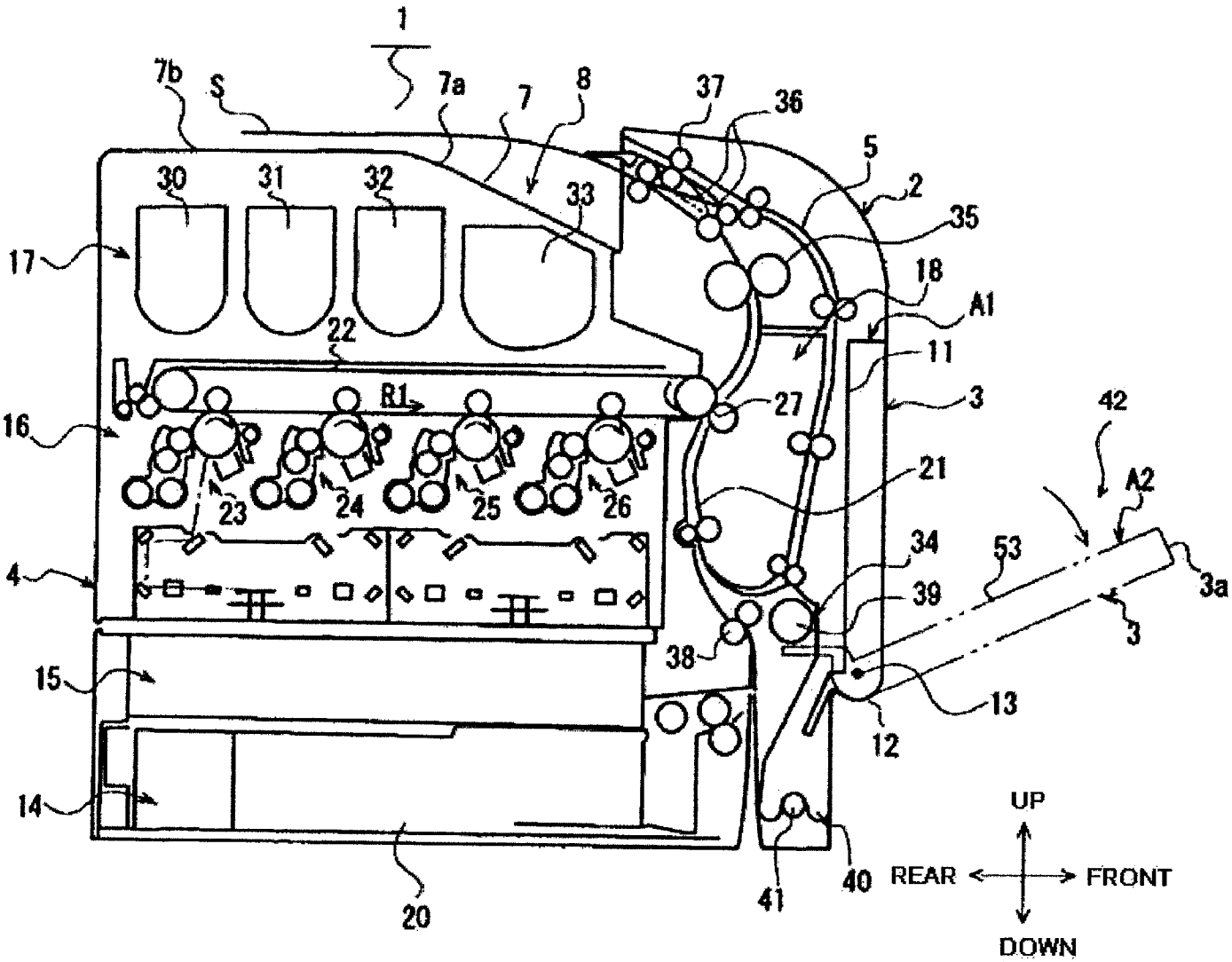

【FIG.3】
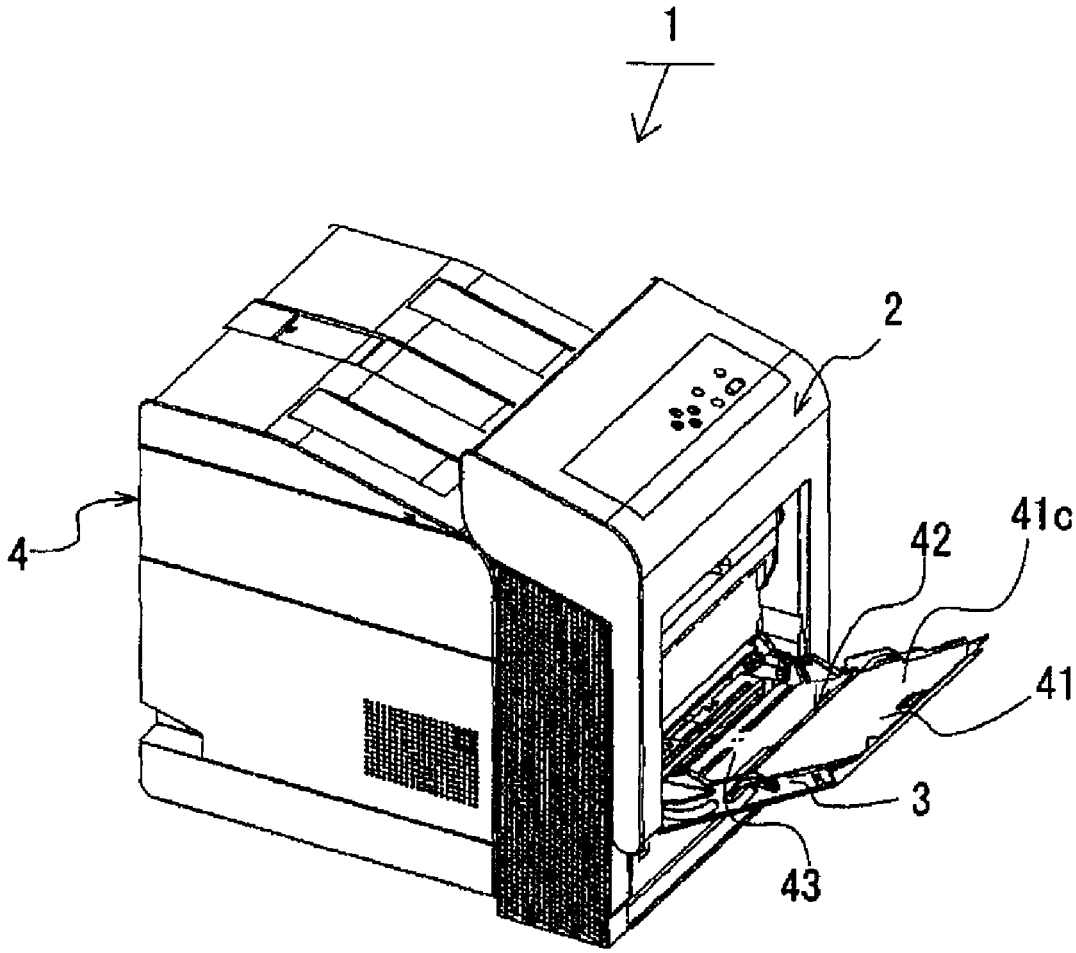

【FIG.4】
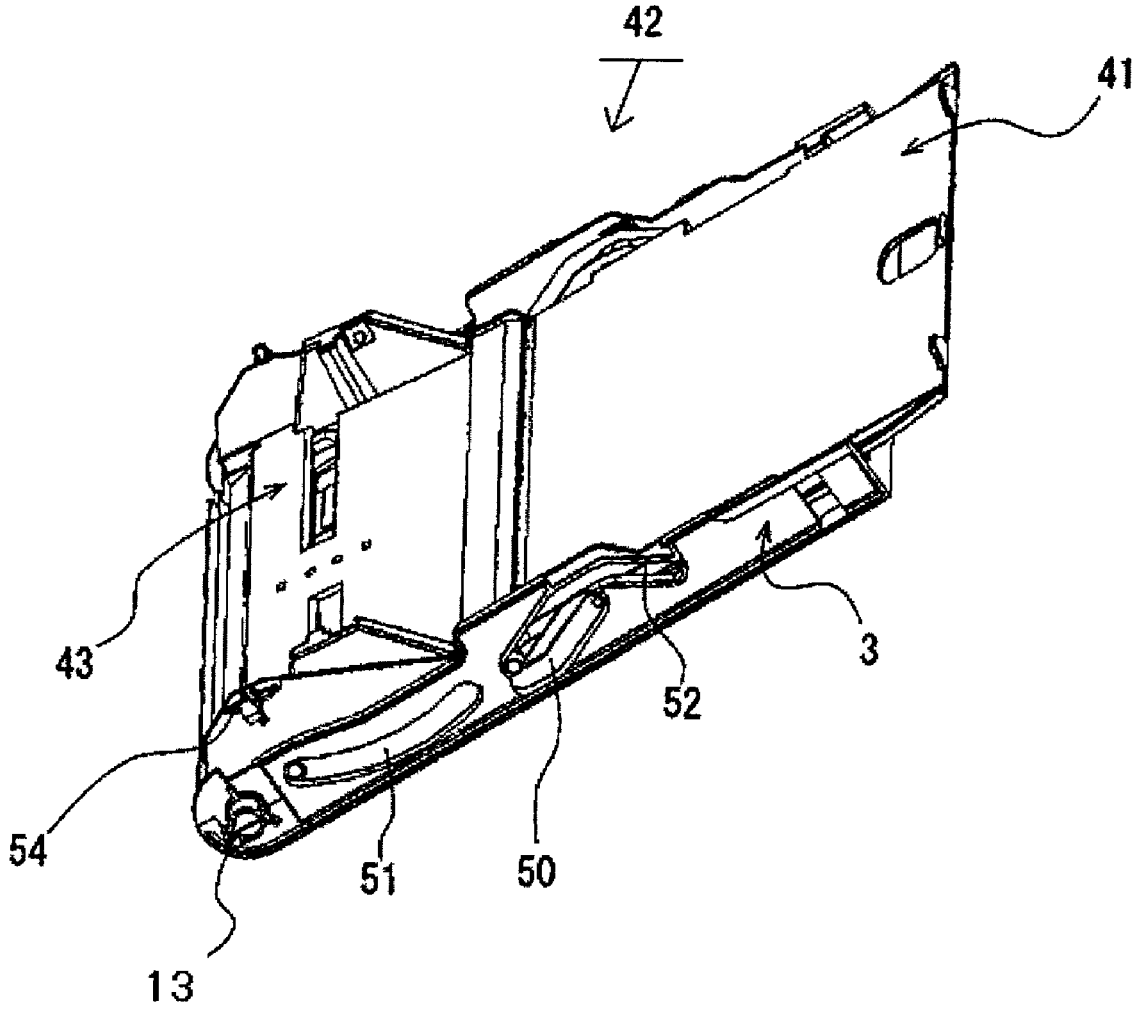

【FIG.5】
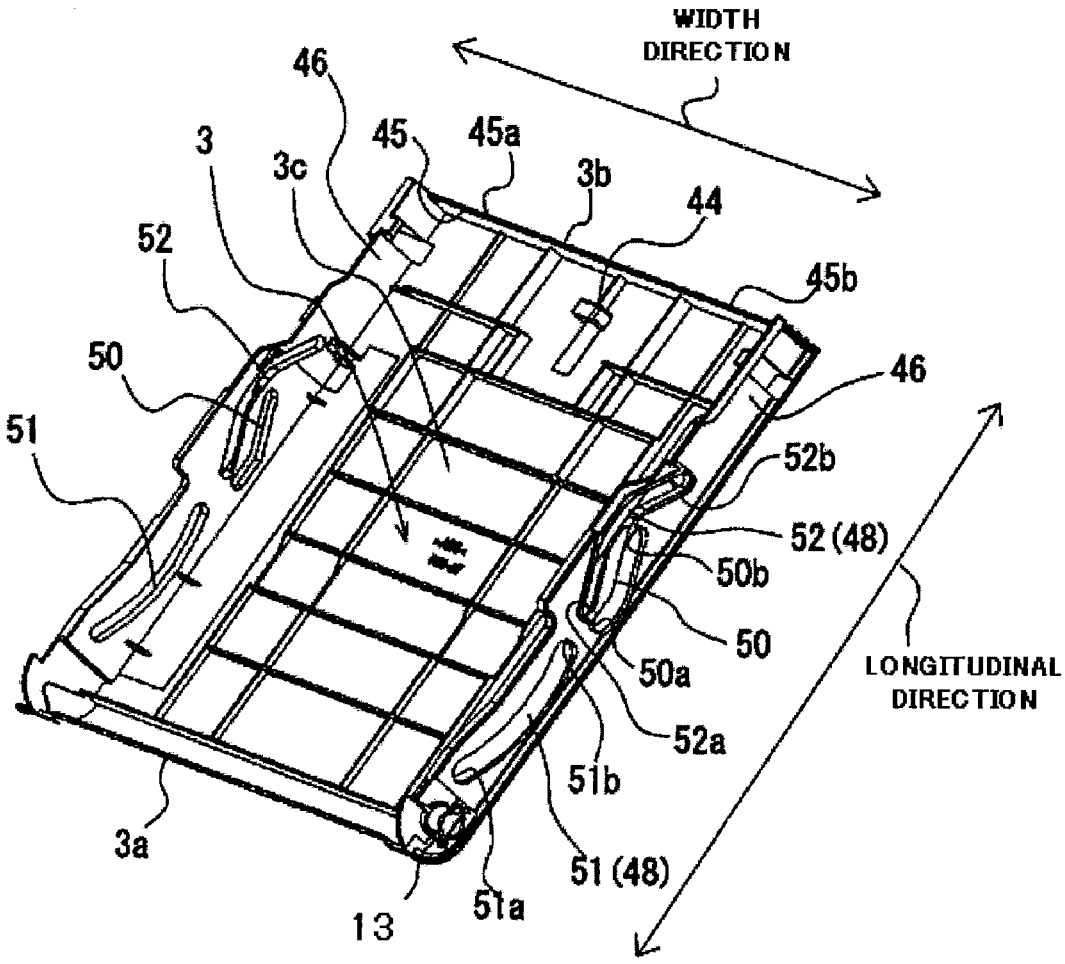

【FIG.6】
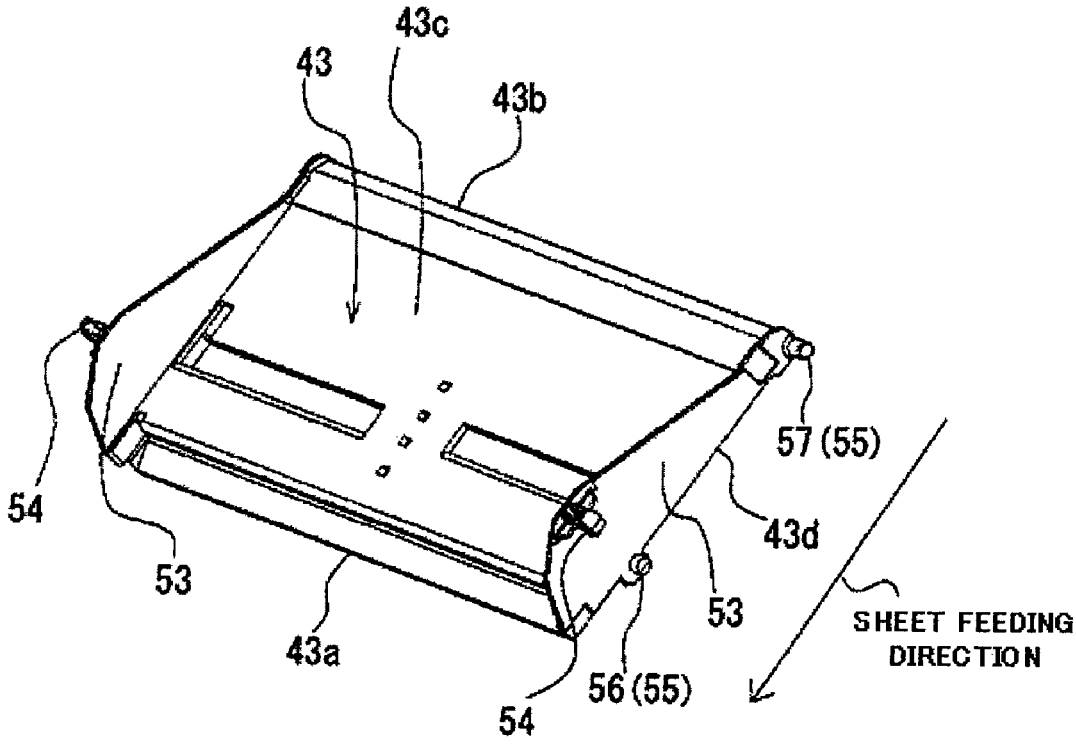

【FIG.7】
(a)
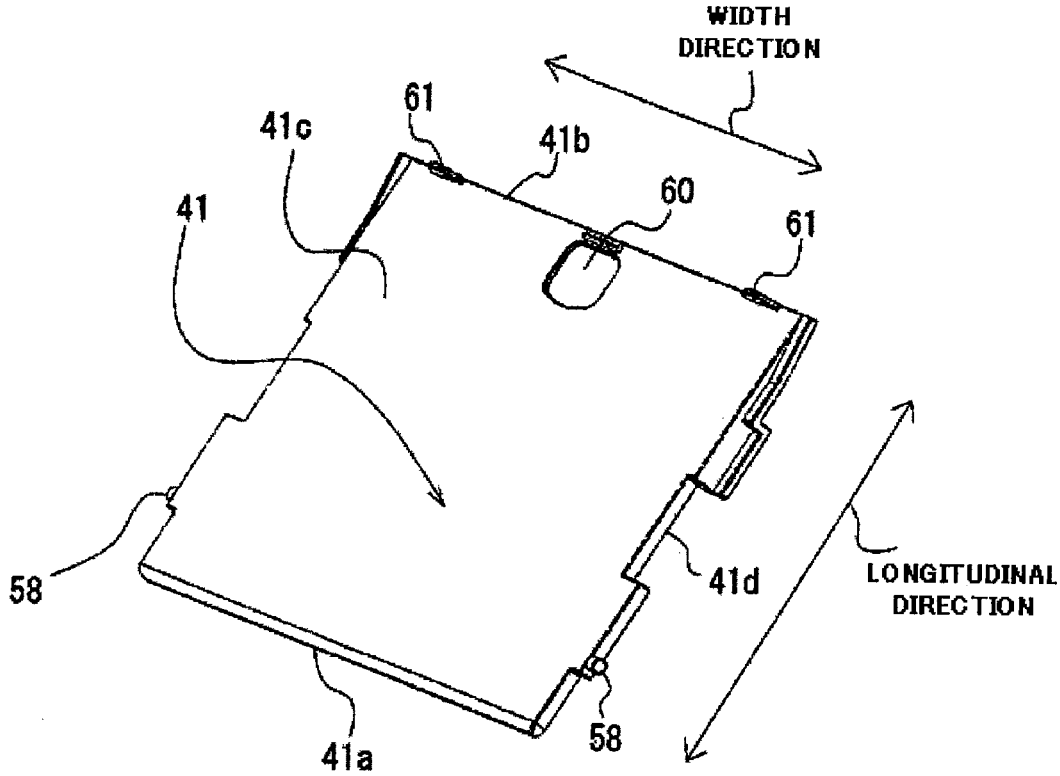
(b)
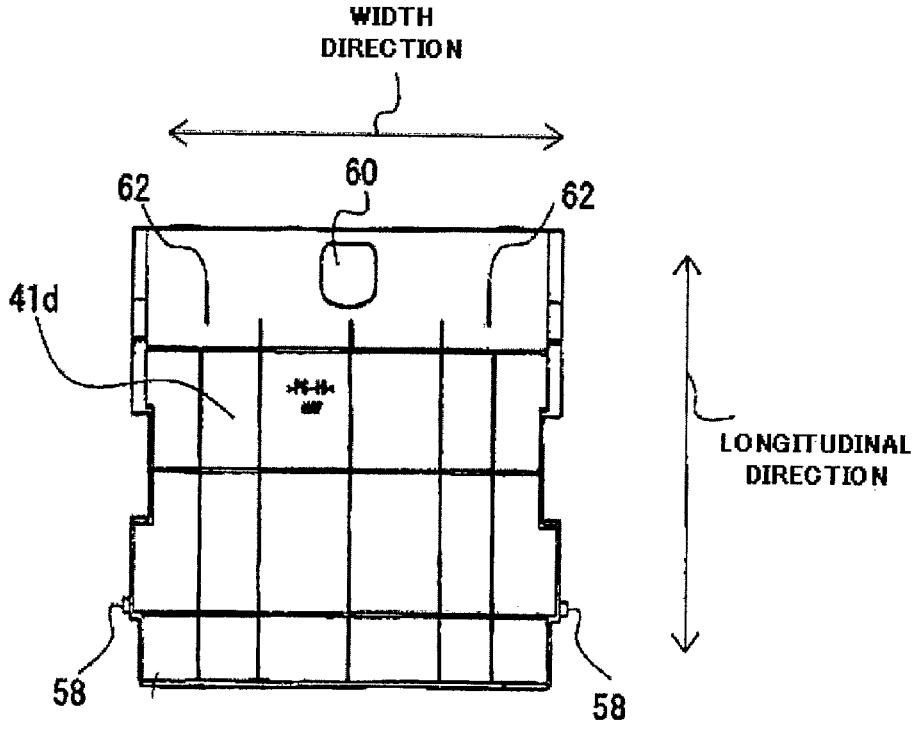

【FIG.8】
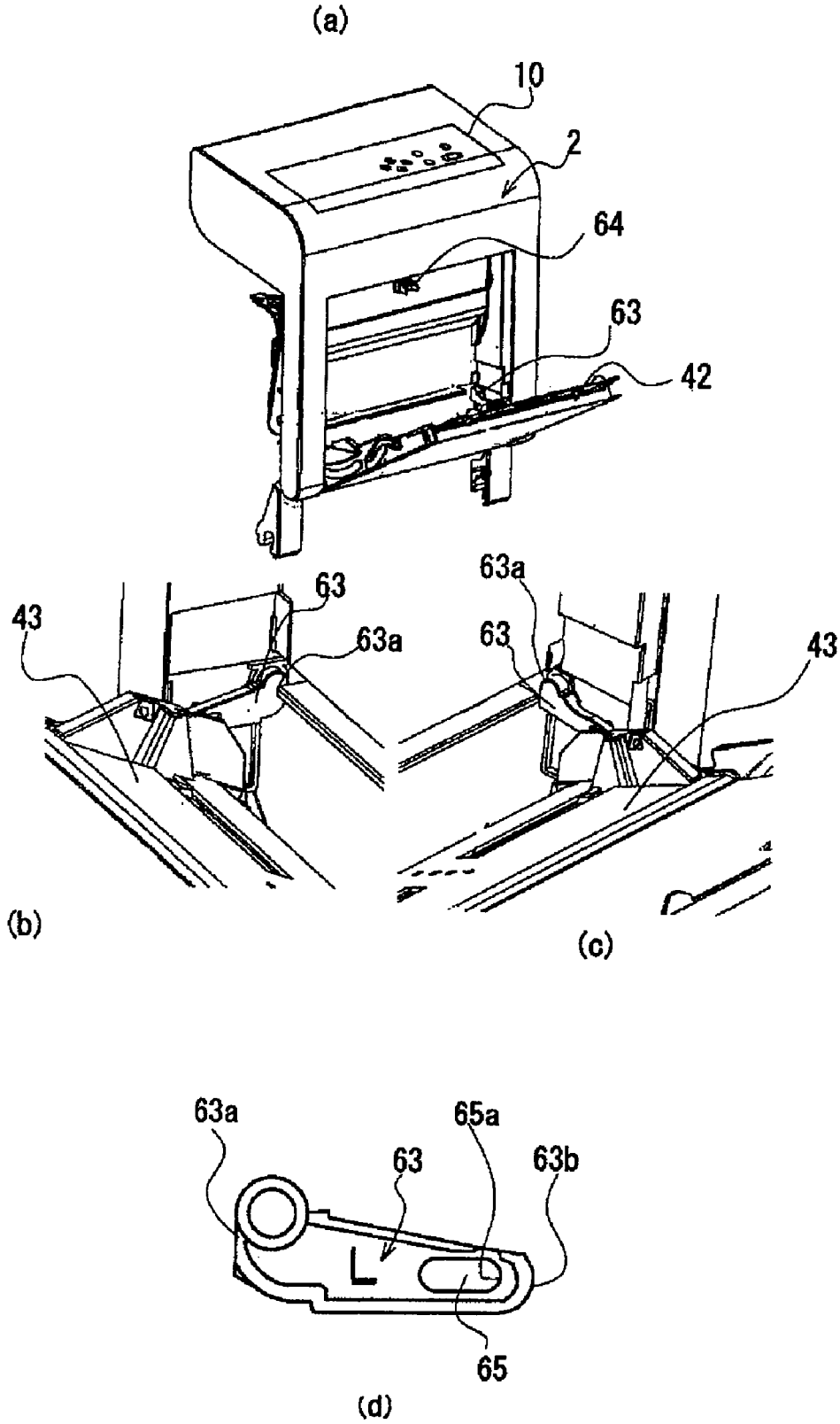

【FIG.9】
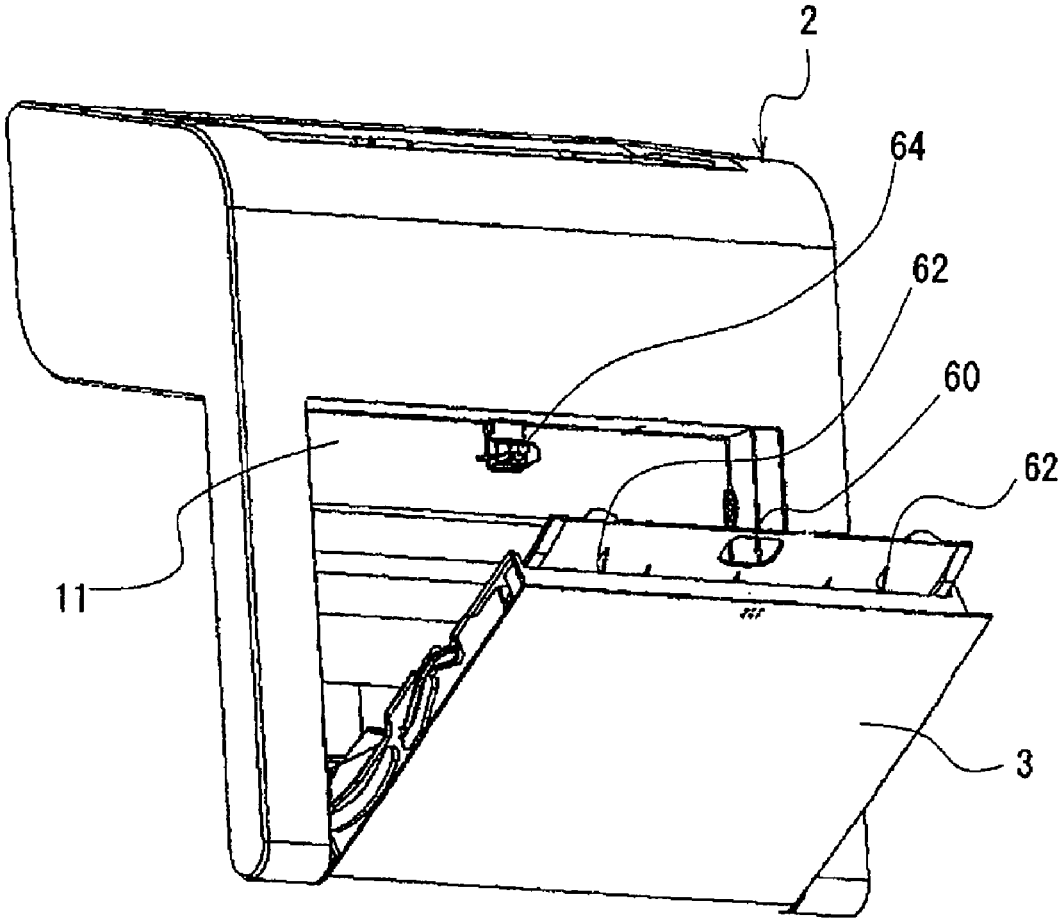

【FIG.10】
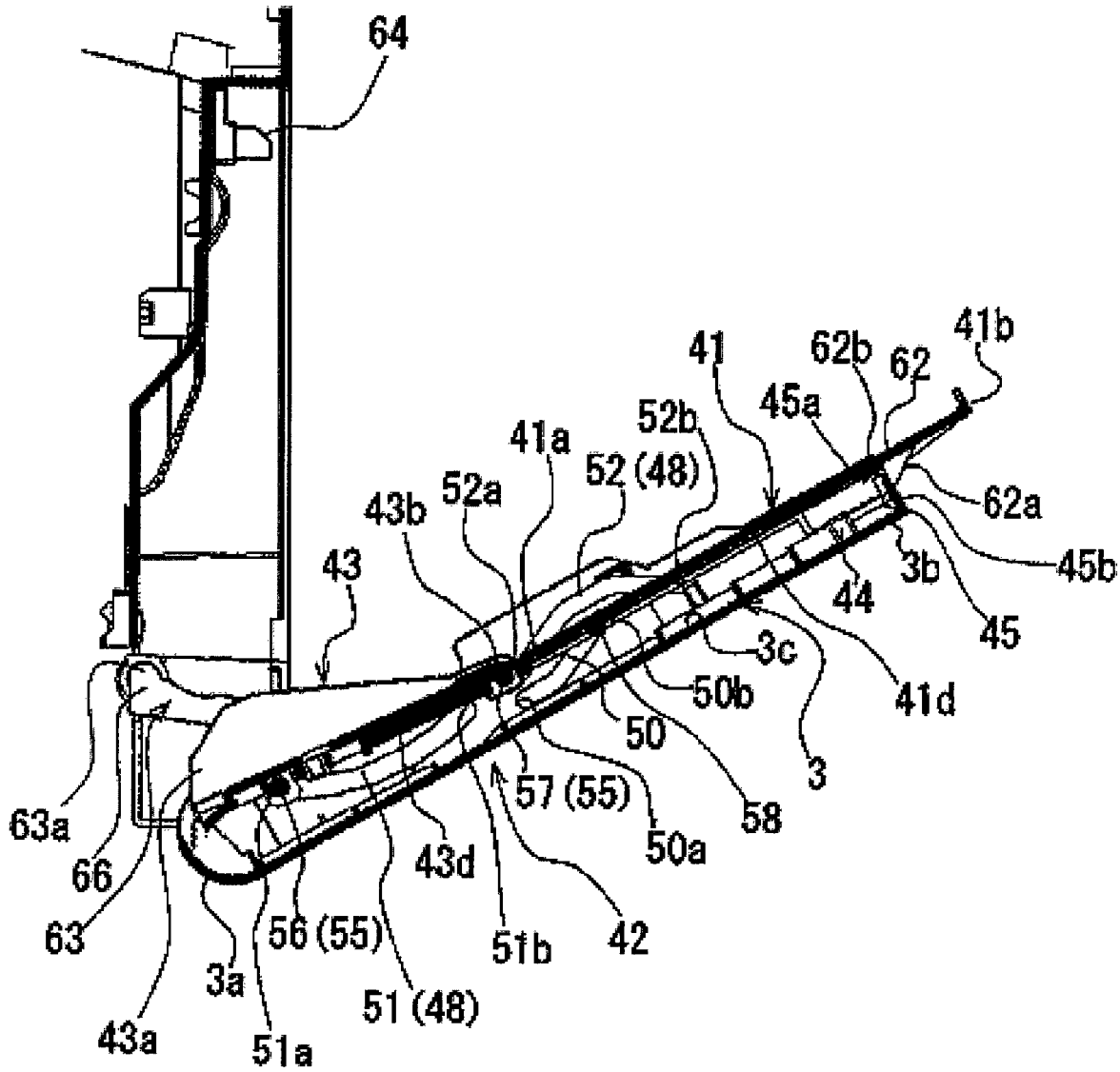

【FIG.11】
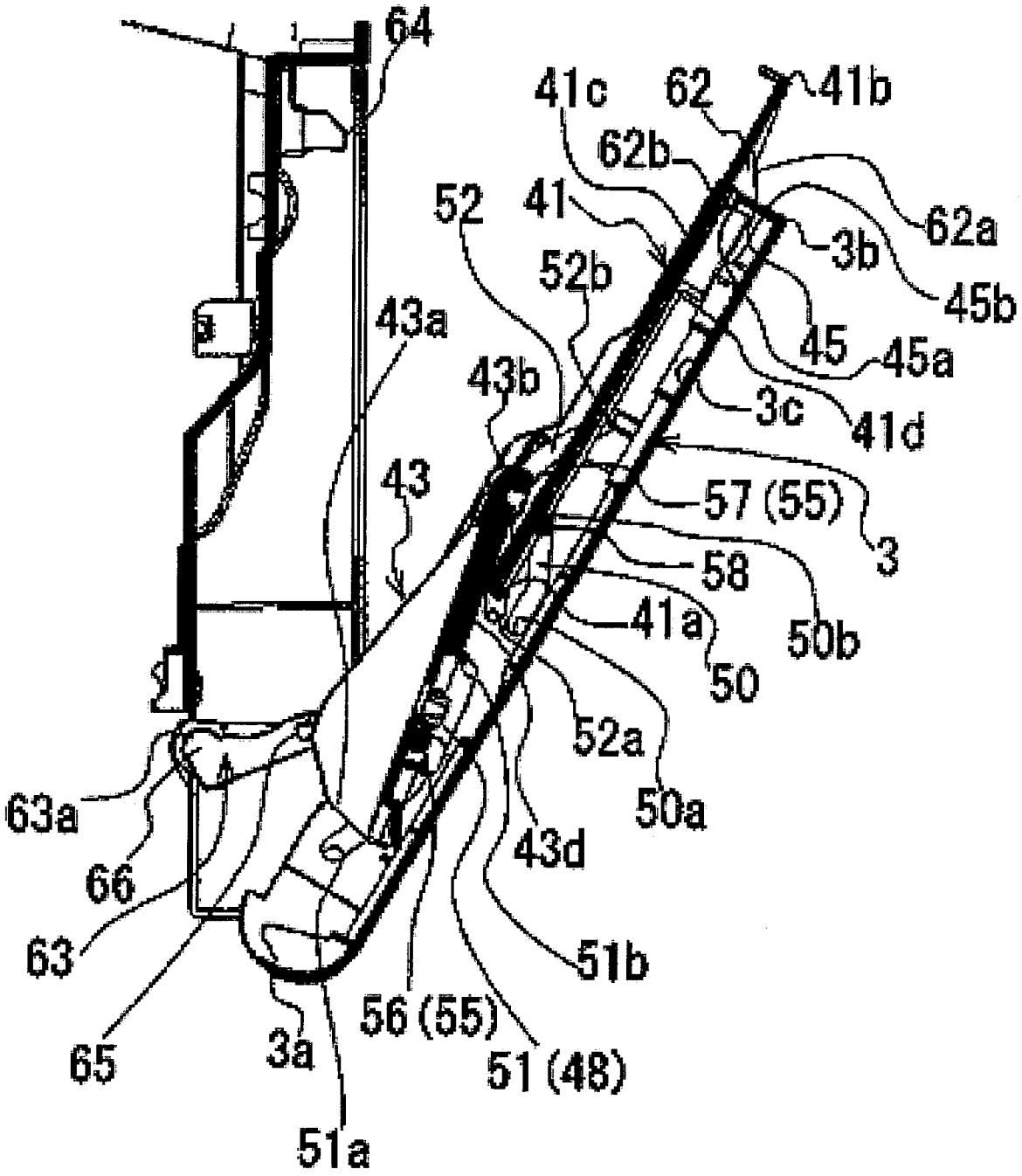

【FIG.12】
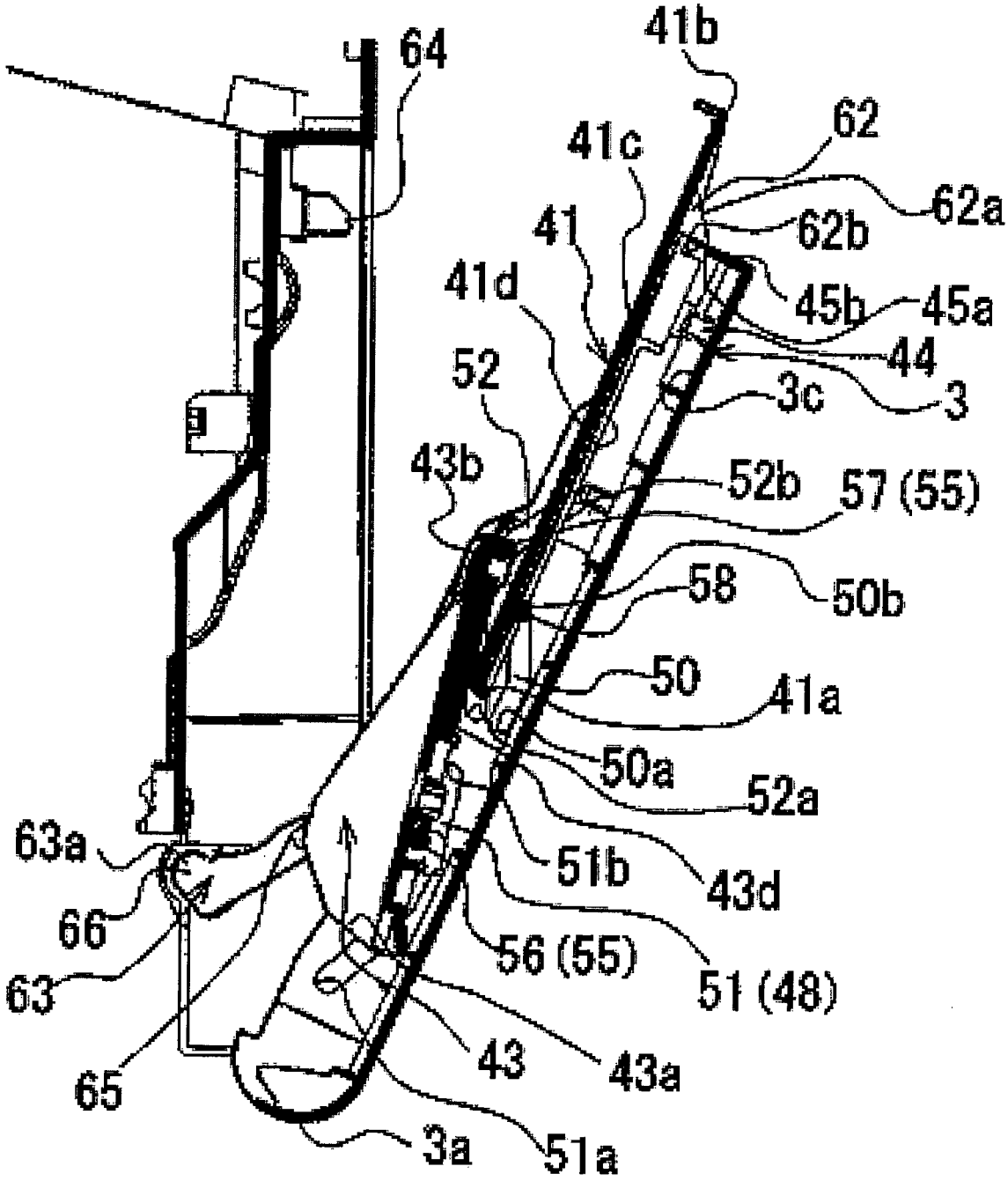

[FIG 13]
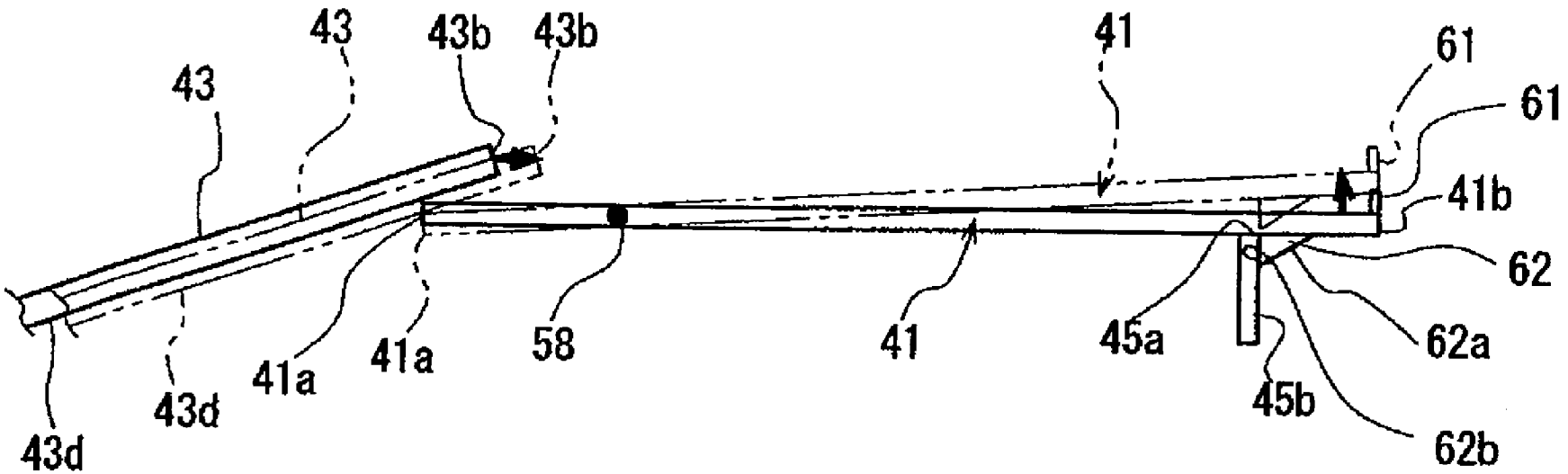

【FIG.14】
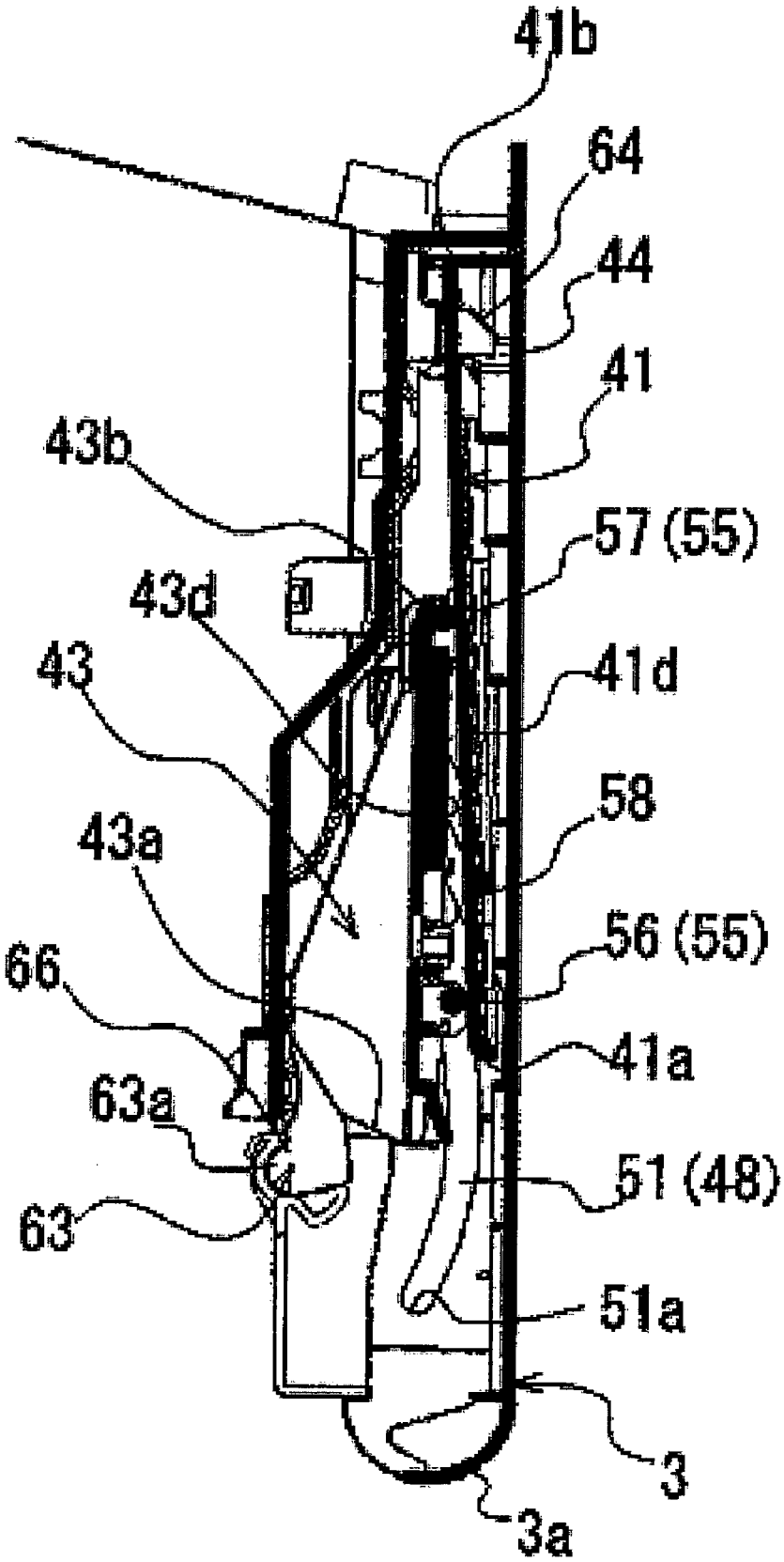

[FIG.15]
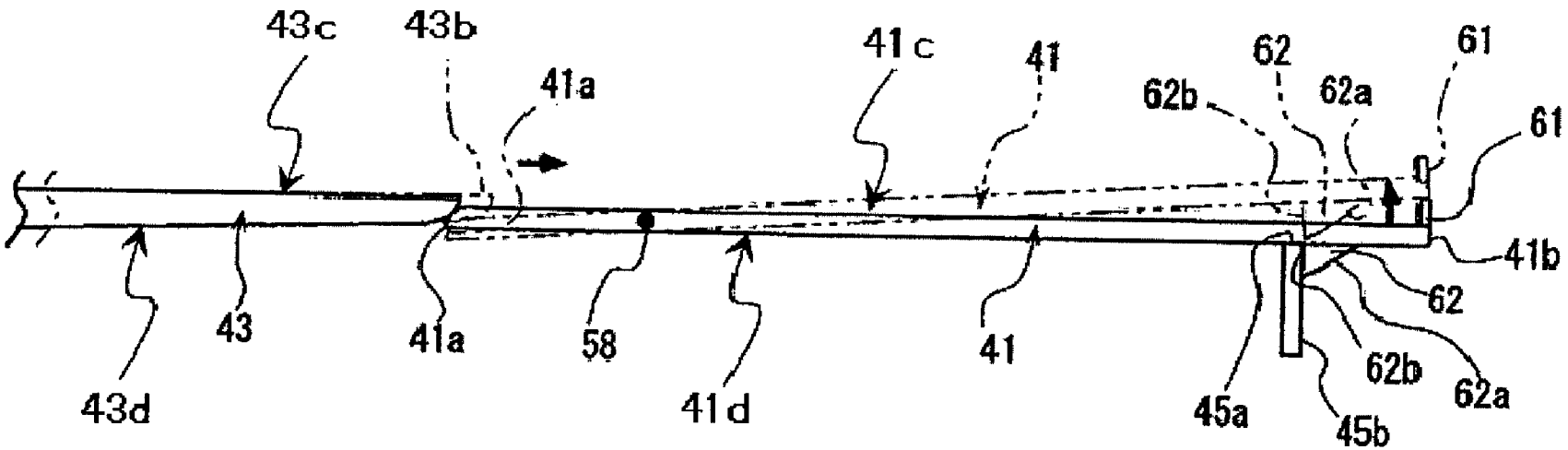

【FIG.16】
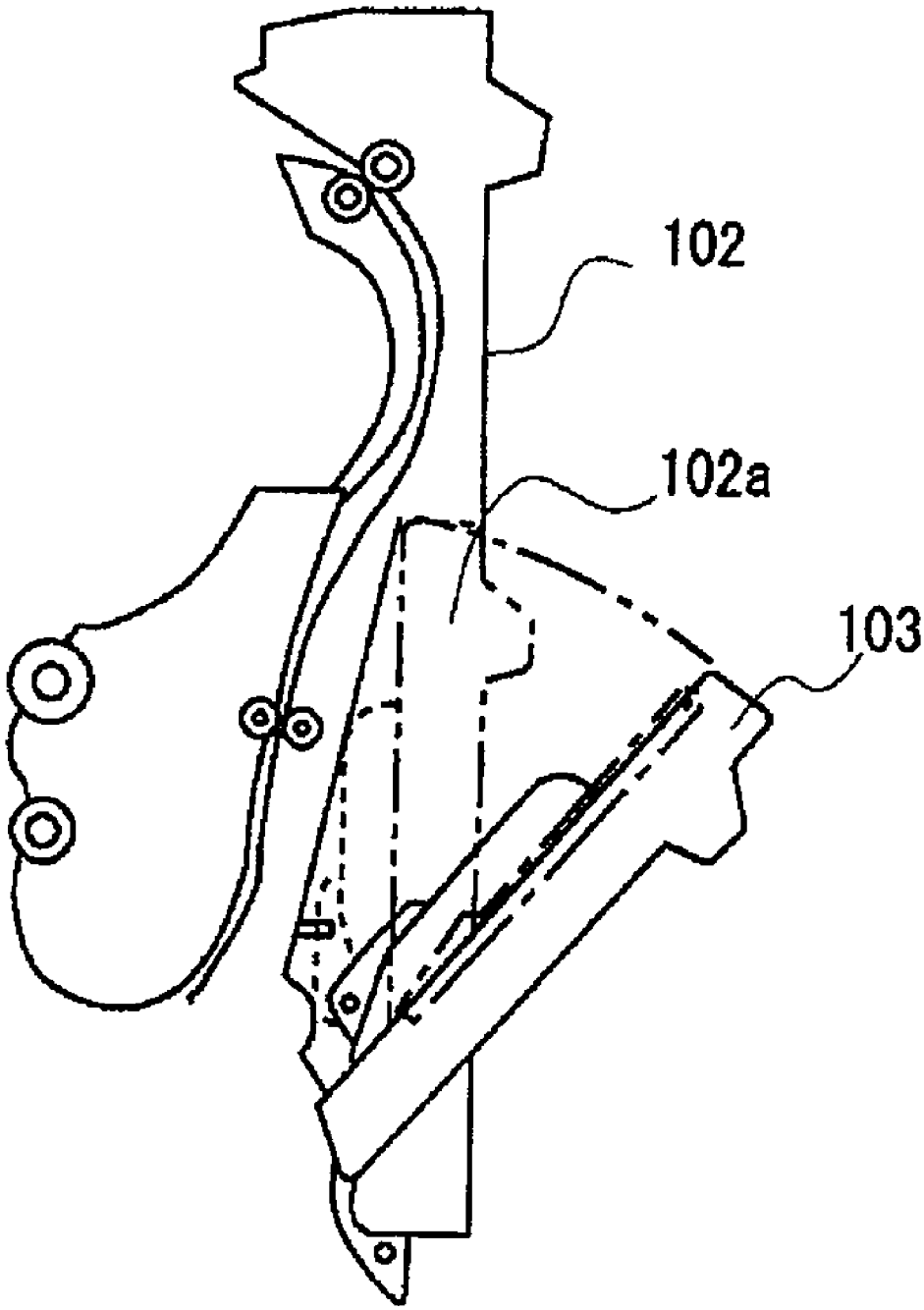

【FIG.17】
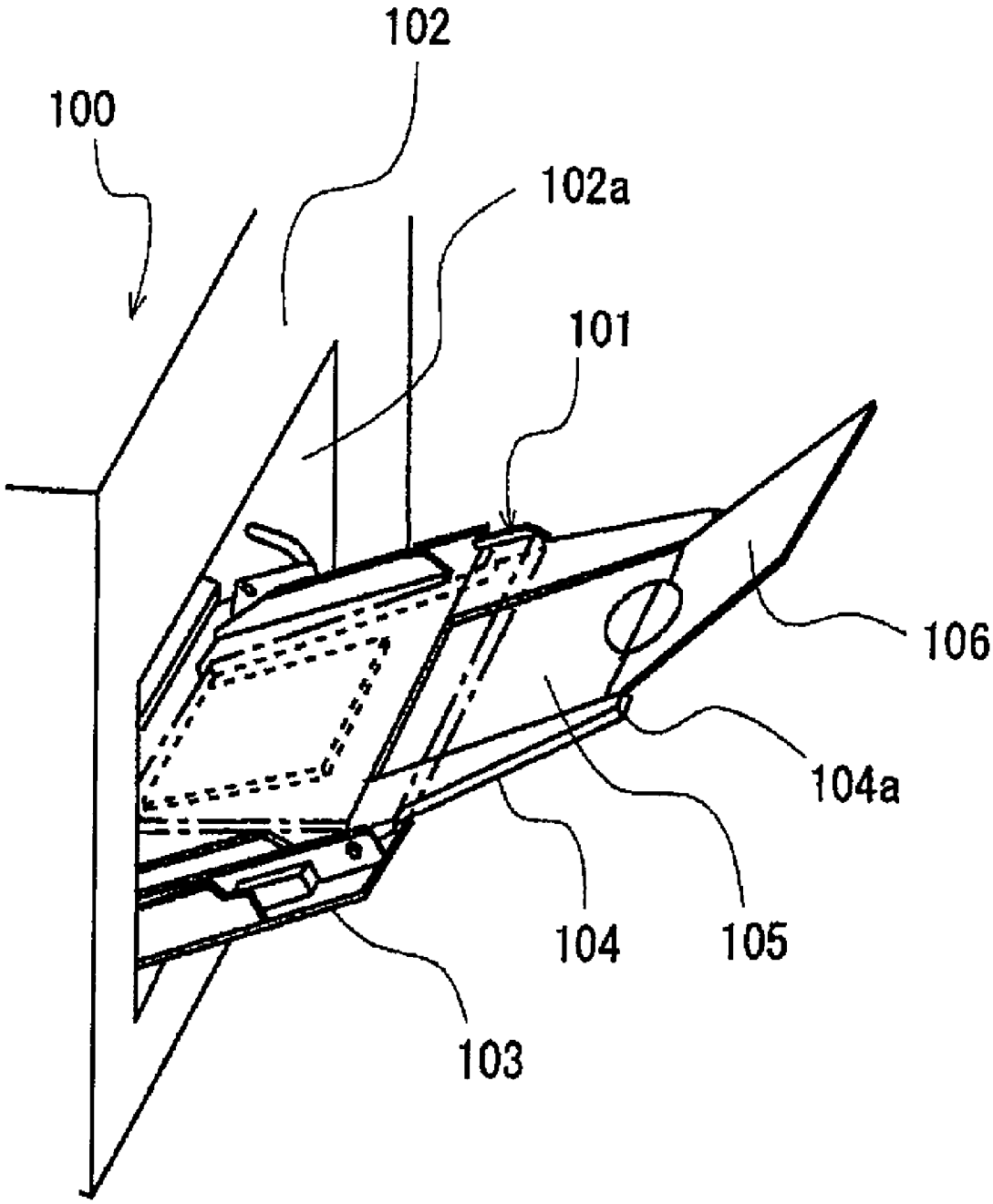

【FIG.18】
(a)
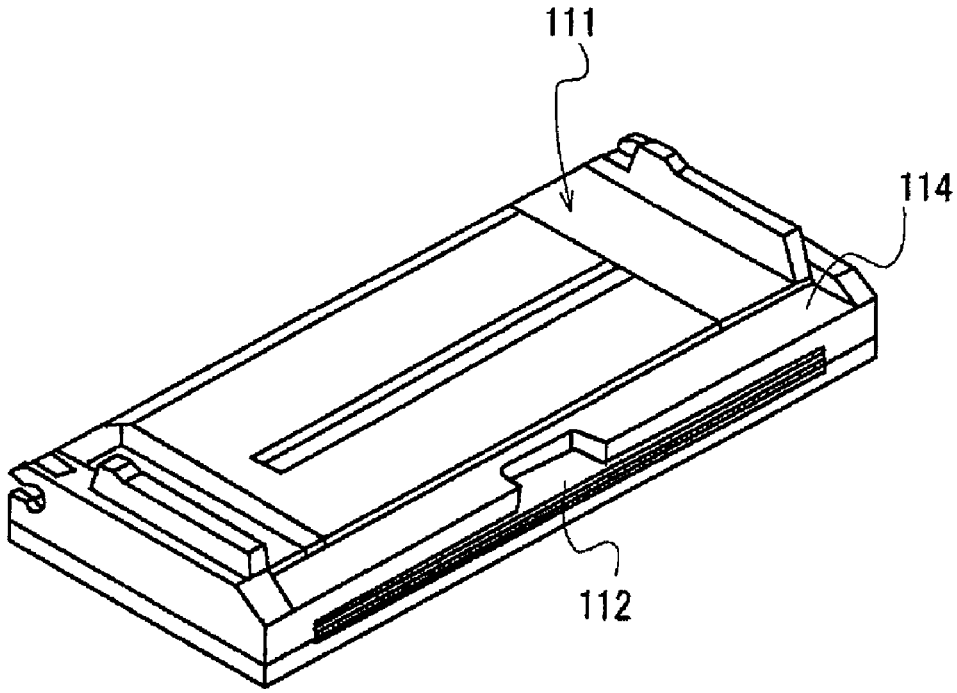
(b)
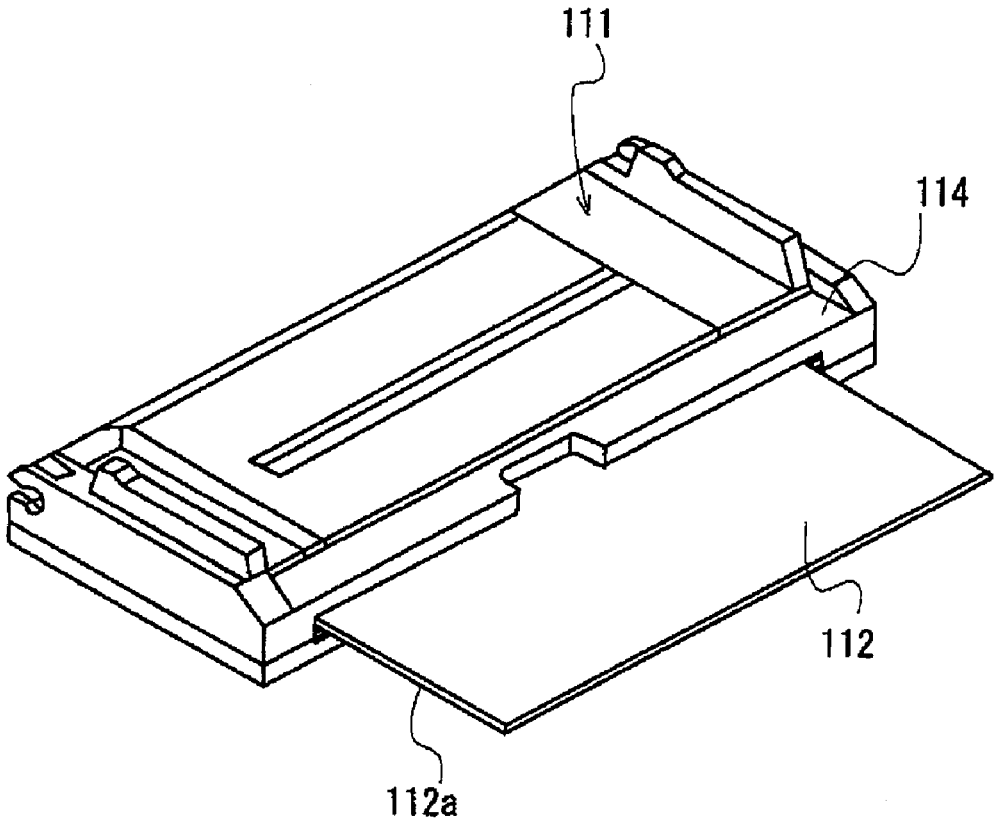

【FIG.19】
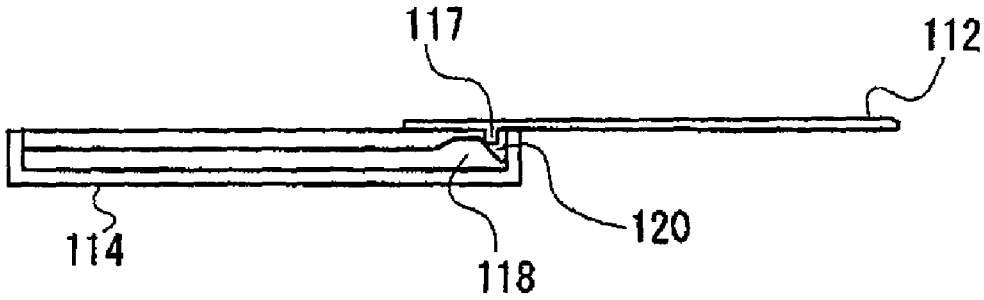

【FIG.20】
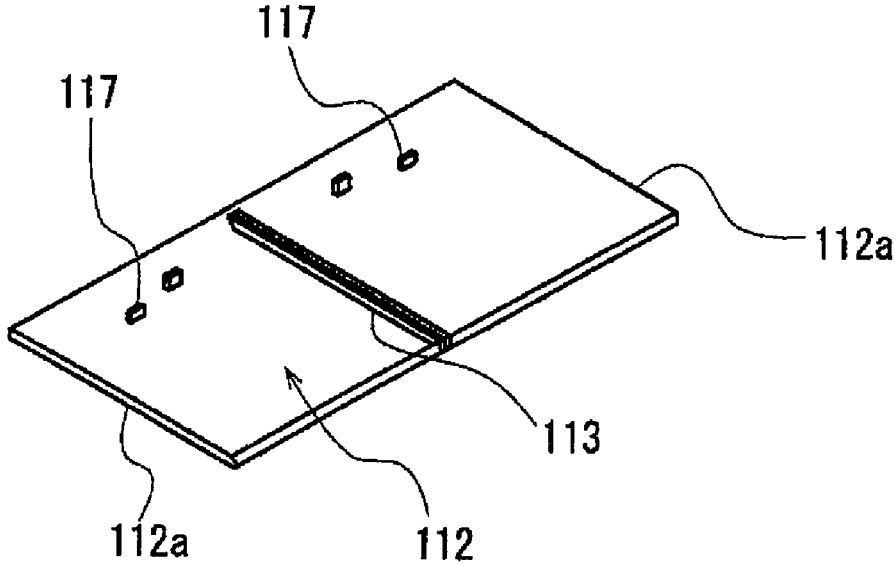
(a)
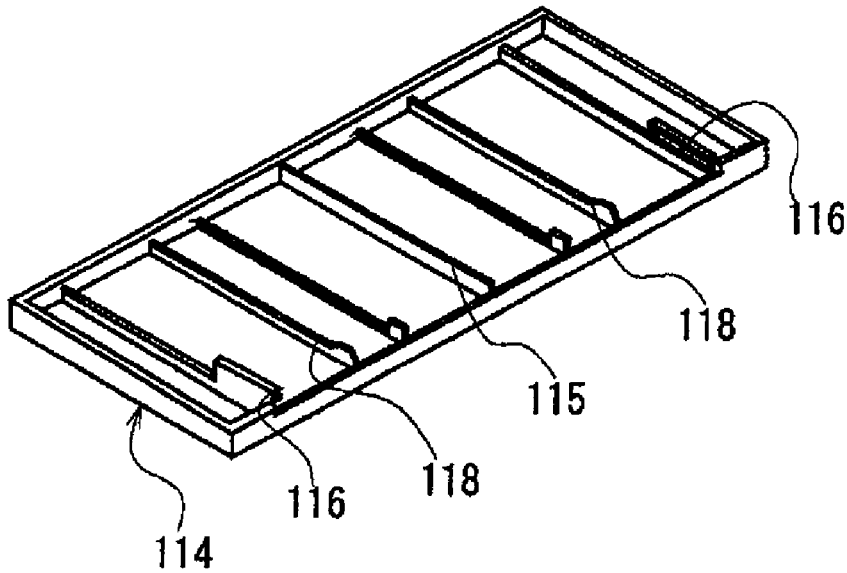
(b)

【FIG.21】
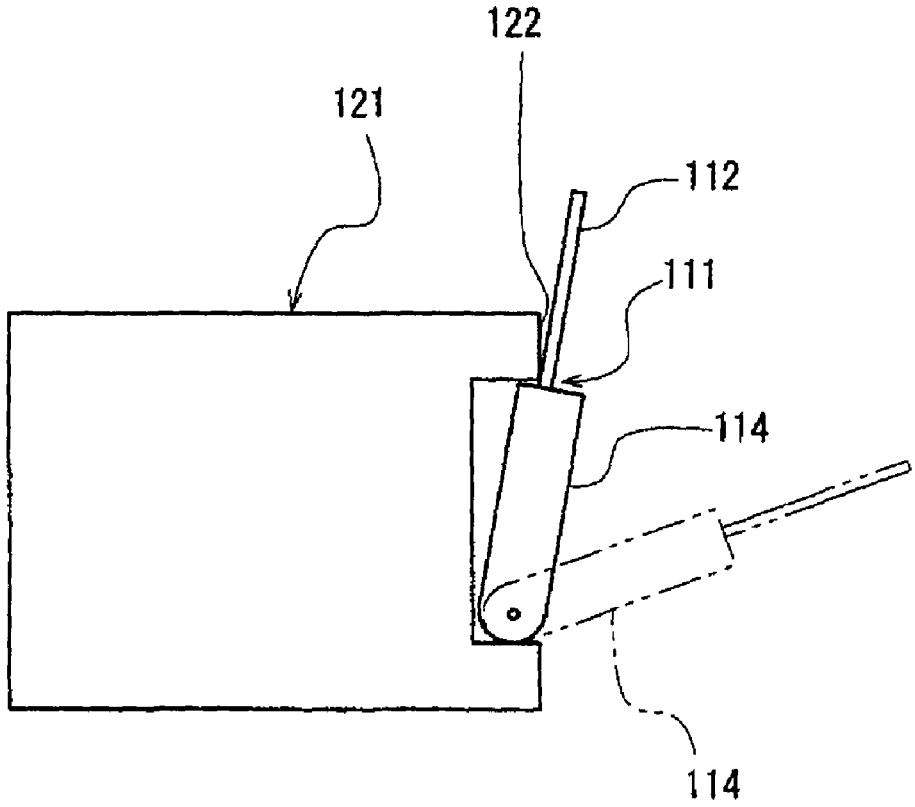

MANUAL FEED TRAYS AND IMAGE FORMING APPARATUS

INCORPORATION BY REFERENCE

This application is based upon and claims the benefit of priority from the corresponding Japanese Patent Application No. 2008-114191, filed Apr. 24, 2008, the entire contents of which is incorporated herein by reference.

BACKGROUND

1. Field of the Invention

The present invention relates to manual feed trays and image forming apparatus including the manual feed trays.

2. Description of the Related Art

Image forming apparatus such as copying machines, facsimile apparatus, printers, and combinations thereof include, apart from a main body feeding cassette for feeding paper that is frequently used, mechanisms including a tray for allowing for the manual feed of paper. The manual feed tray can be used for feeding paper sheets of a size that is not frequently used or special kinds of paper sheets such as postcards and envelopes. In the above-mentioned image forming apparatus such as copying machines, facsimile apparatus, printers, and combinations thereof, one of the goals is to reduce the size of the apparatus so as to provide for space saving.

In order to achieve the above-mentioned goal, when the manual feed tray is not used, the tray is located within the image forming apparatus main body to define a side surface of the image forming apparatus main body, and when the tray is used, the manual feed tray is moved to a sheet feeding position by pulling out the forward end thereof. In order to provide a sufficient stacking surface for supporting the paper, it is common practice to pull out an extension member from the manual feed tray. Since the forward end of the manual feed tray is upwardly inclined, the extension member has a lock mechanism for retaining the extension member at the pulled-out position so as to prevent the extension member from falling off.

FIGS. 16 and 17 illustrate a first prior art example. As illustrated in FIG. 16, when a manual feed tray 101 is not used, the manual feed tray 101 is located in a portion 102*a* (indicated by the chain double-dashed line) formed in a side surface 102 of an image forming apparatus main body 100. As illustrated in FIG. 17, when the manual feed tray is to be used, a cover member 103 is opened to a sheet feeding position, and a first tray 104 is pulled out of the cover member 103. Further, a second tray 106, folded into a recess 105 of the first tray 104, is swung open around a forward end portion 104*a* of the first tray 104. As a result, a sheet stacking surface of the manual feed tray 101 is provided.

FIGS. 18 through 21 illustrate a second prior art example. Provided is a manual feed tray 111 having a main body 114 and an extension tray 112. The main body 114 has a guide rib 115 and side restriction grooves 116. The extension tray 112 has a guide rail 113 in the back surface of the extension tray 112. The guide rail is fitted with a guide rib 115 so as to be slidable on the guide rib 115, and both side portions 112*a* (both side portions in a direction orthogonal to the pulled-out direction) of the extension tray 112 are fitted with side restriction grooves 116 so as to be slidable in the grooves 116. As a result, the extension tray 112 is slidable without being detached from the manual feed tray main body 114. Further, in the manual feed tray 111, when the extension tray 112 is pulled out, positioning protrusions 117 on the back side of the extension tray 112 move over positioning ribs 118 of the manual feed tray main body 114, with the extension tray 112 itself being elastically deformed. When the extension tray 112 is pulled out to a predetermined position (sheet feeding position), the positioning protrusions 117 of the extension tray 112 are received into a positioning recess 120 of the manual feed tray main body 114 and locked therein. When restoring the extension tray 112 to the former position (the position prior to being pulled-out), as long as the operator does not push the forward end side of the extension tray 112 to release the engagement of the positioning protrusions 117 and the positioning recess 120 (i.e., to release the lock), the extension tray 112 is retained at a predetermined position (sheet feeding position), and the extension tray 112 will not be automatically restored to the former position (position prior to being pulled-out).

In the manual feed tray 101 disclosed in the first prior art example, each time the manual feed tray 101 is closed, the user has to move the second tray 106 and the first tray 104 into the storage position, resulting in a bother. When the manual feed tray 101 is moved to the storage position, with the second tray 106 and the first tray 104 being left unmoved, the side surface 102 of the image forming apparatus main body 100 and the first tray 104 abut each other or the side surface 102 and the second tray 106 abut each other, and there is a possibility that the first tray 104, the second tray 106 or the side surface 102 of the image forming apparatus main body 100 can be damaged.

Referring to FIG. 21, the manual feed tray 111 of the second prior art example can be located in the image forming apparatus main body 121. When the user forgets to store the extension tray 112, from the sheet feeding position (position indicated by the chain double-dashed lines), due to the lock mechanism described above, the extension tray 112 is retained in the state when the extension tray 112 is pulled out of the manual feed tray 114. Thus, the extension tray 112 moves to the storage position in the image forming apparatus main body 121 while the extension tray 112 is retained in a pulled-out position. As a result, because the side surface 122 of the image forming apparatus main body 121 and the extension tray 112 abut each other, as illustrated in FIG. 21, there is possibility that the extension tray 112 and the side surface 122 of the image forming apparatus main body 121 can be damaged. Thus, the operator has to ensure that the extension tray 112 is stored every time the operator stores the manual feed tray 111, which is a bother.

SUMMARY

In view of this, it is an advantage of the present invention to eliminate the trouble of storing the extension tray each time the operator stores the manual feed tray into the image forming apparatus main body. Additionally, an advantage is to prevent damage to the tray extensions and the image forming apparatus main body when the operator forgets to store the tray extensions.

According to an embodiment of the present invention, a manual feed tray is provided comprising a cover member pivotably supported at a lower end and having a storage position and a sheet feeding position; a sheet feeding platform located at the lower end side of the cover member in the sheet feeding position, and mounted to the cover member so as to be capable of sliding toward the upper end side of the cover member and so as to leave a gap between the sheet feeding platform and itself; and an extension member assuming a storage position in which the extension member is stored in the gap between the sheet feeding platform and the cover member and a pulled-out position wherein, in the pulled-out position, a locking protrusion formed on the back surface on a distal end side of the extension member is hooked on an end edge of the upper end side of the cover member, and is pivotally retained so as to move away from the cover member. In the process in which the cover member is pivoted from the sheet feeding position to the storage position, the sheet feeding platform is moved to the upper end side of the cover member by an extension member lock releasing mechanism interlocked with the pivoting of the cover member, pivots the extension member, and separates the locking protrusion of the extension member from the end edge of the upper end side of the cover member, with the extension member moving into the gap between the cover member and the sheet feeding platform so as to be positioned therein.

Additional features and advantages are described herein, and will be apparent from the following Detailed Description and the figures.

BRIEF DESCRIPTION OF THE FIGURES

In the accompanying drawings:

FIG. 1 is a general perspective front elevational view of an image forming apparatus;

FIG. 2 is a schematic diagram illustrating the inner construction of the image forming apparatus as seen from the left-hand side;

FIG. 3 is a perspective front elevational view of the image forming apparatus, with a cover member being opened and a manual feed tray assuming a sheet feeding position;

FIG. 4 is a perspective front elevational view of the manual feed tray;

FIG. 5 is a perspective rear elevational view of the cover member;

FIG. 6 is a perspective rear elevational view of a sheet feeding platform;

FIG. 7A is a perspective rear elevational view of an extension guide, and FIG. 7B is a rear view of the extension guide;

FIG. 8A is a diagram illustrating the manual feed tray when opened at a permissible opening angle by an opening/closing restraint link (connecting member), FIG. 8B is an enlarged view of a left-hand side opening/closing restraint link (connecting member), FIG. 8C is an enlarged view of a right-hand side opening/closing restraint link (connecting member), and FIG. 8D is an enlarged view of a left-hand side link lever 63 when detached from a front cover;

FIG. 9 is a perspective view, as seen from below and from the left-hand front side, of the image forming apparatus, with the cover member being opened from the front cover and the manual feed tray assuming the sheet feeding position;

FIG. 10 is a sectional view of the manual feed tray assuming the sheet feeding position;

FIG. 11 is a sectional view of the sheet feeding platform and the extension guide in contact with each other;

FIG. 12 is a sectional view illustrating when a hooking portion of the extension guide is released;

FIG. 13 is a schematic diagram illustrating how the back surface of the sheet feeding platform is moved into contact with the proximal end of the extension guide;

FIG. 14 is a sectional view of the manual feed tray when stored;

FIG. 15 is a schematic view of another embodiment of the present invention;

FIG. 16 is a sectional view illustrating how a manual feed tray according to a first prior art example is stored in the image forming apparatus main body;

FIG. 17 is a perspective front elevational view illustrating how the manual feed tray of the first prior art example is drawn out of the image forming apparatus main body;

FIG. 18A is a perspective front elevational view illustrating how an extension tray is accommodated in a tray unit according to a second prior art example, and FIG. 18B is a perspective front elevational view illustrating how the extension tray of the tray unit of the second prior art example is extended;

FIG. 19 is a sectional view of the tray unit of the second prior art example;

FIG. 20A is a perspective front elevational view of the extension tray of the second prior art example, and FIG. 20B is a perspective front elevational view of the manual feed tray of the second prior art example; and FIG. 21 is a schematic diagram illustrating how a side surface of the image forming apparatus main body and the stacking surface of the extension tray of the second prior art example are held in contact with each other.

DETAILED DESCRIPTION

In the following embodiments of the present invention, reference is made to the drawings. In the drawings, the same members are denoted by the same reference symbols, and a redundant description thereof is omitted as appropriate. Further, in the drawings, some members may be irrelevant to the description and are omitted as appropriate.

(General Construction of Image Forming Apparatus)

FIGS. 1 through 3 are figures schematically illustrating the structure of an image forming apparatus 1 according to an embodiment. Of those, FIG. 1 is a general perspective top elevational view from the left-hand side, of the image forming apparatus 1. FIG. 2 is a schematic diagram, as seen from the left-hand side, illustrating the inner construction of the image forming apparatus 1. In FIGS. 1 and 2, the arrows indicate the front, rear, left-hand, right-hand, upper, and lower sides of the image forming apparatus 1.

Examples of the image forming apparatus 1 include a copy machine, facsimile apparatus, printer, and combinations thereof. In the specific example described below, the image forming apparatus 1 is a printer, however, the present invention is, of course, not limited thereto. The image forming apparatus 1 illustrated in the example FIGS. 1 through 3 is a four-full-color electrophotographic image forming apparatus using an intermediate transfer system and a tandem system.

Referring to FIG. 1, the general outward structure of the image forming apparatus 1 is described. The image forming apparatus 1 includes a substantially box-shaped (parallelpiped) main body 4, and a front cover 2 supported by the main body 4 so as to be openable/closable (pivotable). In the main body 4, sheet conveying paths 21 and 5 on the front side are covered by the front cover 2 (see FIG. 2), and the left-hand side surface and the right-hand side surface of the main body 4 are covered with a left-hand side exterior panel 6 and a right-hand side exterior panel (not shown) made of a synthetic resin (see FIG. 2). On the upper surface of the main body 4, there is arranged a discharge tray 8 having a sheet stacking surface 7 for stacking sheets. The sheet stacking surface 7 is formed by an inclined surface 7*a* gently sloping so as to be higher at a rear end side and a flat surface 7*b* connected to the rear end of the inclined surface 7*a*. And the sheet stacking surface 7 supports sheets which are discharged from a discharge port (not shown) after image formation, If a paper jam occurs in the sheet conveying paths 21 and 5, the front cover 2 can be rotated by releasing a lock mechanism (not shown) fixed to the main body 4. It is then possible to open the sheet conveying paths 21 and 5 of the main body 4 to the exterior, making it possible to remove the jammed paper S from the path 5 (see FIG. 2).

An operation panel 10 is provided at the upper end of the front cover 2. On the operation panel 10, a touch-panel type liquid crystal displays and various buttons can be provided. An operator (e.g., user or serviceman) can operate the image forming apparatus 1 by using the operation panel 10.

Further, the front cover 2 has a cover member 3 pivotally mounted in a front-side (outer side) recess 11 thereof. The cover member 3 located in the recess 11 of the front cover 2 can be pulled out by being pivoted from a storage position A1 indicated by the solid line of FIG. 2 to a sheet feeding position A2 indicated by the double-dashed line. As illustrated in FIG. 2, the cover member 3 is supported so as to be pivotable around a support shaft 13 of a proximal end 12 positioned on the lower end side thereof. The support shaft 13 is received in a shaft hole (not shown) of the front cover 2.

Next, the inner construction of the image forming apparatus 1 is described with reference to FIG. 2.

As illustrated in FIG. 2, the image forming apparatus 1 includes a sheet accommodating portion 14, a board accommodating portion 15, an image forming portion 16, a toner supply portion 17, and a discharge tray 8, which are arranged from the lower to the upper side of the main body 4 in that order. Further, a sheet conveying portion 18 is provided between the front side of the main body 4 and the front cover 2.

A sheet feeding cassette 20 is located in the sheet accommodating portion 14. One of a plurality of sheets stacked in the sheet feeding cassette 20 is fed into the sheet conveying path 21.

In the board accommodating portion 15, boards (not shown) for controlling the entire image forming apparatus 1 are provided as well as electrical equipments (not shown). The image forming portion 16 is located above the board accommodating portion 15.

In the image forming portion 16, there are arranged an endless intermediate transferring belt 22, and four (four-color) image forming stations aligned in the running direction (indicated by the arrow R1) of the intermediate transferring belt 22, that is, image forming stations 23, 24, 25, and 26 for forming toner images with magenta (M), cyan (C), yellow (Y), and black (K) toners. In the image forming portion 16, the toner images formed by the image forming stations 23 through 26 undergo primary transfer onto the surface of the running intermediate transferring belt 22, and are superimposed one upon the other. Further, the superimposed toner images that have undergone primary transfer onto the intermediate transferring belt 22 undergo secondary transfer onto the sheet at a secondary transfer position 27.

In the toner supply portion 17, there are arranged four toner containers 30, 31, 32, and 33 individually containing the toners of the different colors, e.g., magenta, cyan, yellow, and black.

In this embodiment, the sheet conveying portion 18 includes the sheet conveying path 21 provided between the front side of the main body 4 and the front cover 2 and adapted to guide the sheet conveyed upwards from below, and the sheet conveying path 5 located on the front side of the sheet conveying path 21 and adapted to guide the sheet conveyed downwards from above. Further, the sheet conveying portion 18 includes a manual feeding portion 34. Further, in the sheet conveying path 21, there is provided a fixing device 35 at a position on the downstream side in the sheet conveying direction of the secondary transfer position 27. The sheet conveying path 21 guides the sheet S, to which the toner images have been fixed by the fixing device 35, onto the discharge tray 8, or guides the sheet S into the sheet conveying path 5 (the sheet re-conveying path for double-side printing). When performing double-side printing, a flapper 36 rotates to the position where double-side printing can be performed from the position where single-side printing can be performed, so as to guide the sheet S to the reverse rollers 37. So, the sheet S is conveyed through the sheet conveying path 21 to the reverse rollers 37. Before the front edge of the sheet S reaches the nip potion of the reverse rollers 37, the reverse rollers 37 begin to rotate so that the sheet S is conveyed in the direction of the discharge tray 8 in FIG. 2. Right before the whole sheet S passes through the nip potion of the reverse rollers 37, the reverse rollers 37 stop rotating and the rear part of the sheet S is temporarily held by the reverse rollers 37. And then, the sheet S is conveyed downwards from above by a reverse rotation of the reverse rollers 37, with the sheet S being guided to the sheet conveying path 5. Further, immediately before a pair of conveying rollers 38 in the sheet conveying portion 18, there is provided a manual feeding roller 39. The manual feeding roller 39, feeds the sheet S located on the upper surface of a manual feed tray 42 in the open state (at the sheet feeding position A2) indicated by the double-dashed line of FIG. 2 toward the pair of conveying roller pairs 38.

FIG. 3 is a perspective front elevational view, of the image forming apparatus 1, in which the cover member 3 is opened and an extension guide 41 (extension member) has been pulled out, with the manual feed tray 42 being in the sheet feeding position A2. In the image forming apparatus 1, in addition to the main body sheet feeding cassette 20, a manual feed tray 42 is provided. The paper sheets having a size that is infrequently used or of a special use such as postcards or envelopes are fed using the manual feed tray 42. When the sheet feed operation using the manual feed tray 42 is completed and the manual feed tray 42 is to be stored, the cover member 3 is moved to its storage position, with the extension guide 41 being left as is. Then, the front cover 2 of the main body 4 and the sheet stacking surface 41*c* of the extension guide 41 are moved into contact with each other. There is then the possibility that the sheet stacking surface 41*c* of the extension guide 41 and the front cover 2 could be damaged. In view of this, in the present invention, there is provided a mechanism which releases the extension guide 41 from retention to store the extension guide 41 due to their own weight through an interlocking operation of storing the manual feed tray 42 in the main body 4 from the sheet feeding position A2.

(Structure of Manual Feed Tray)

The manual feed tray 42 will now be described with reference to FIG. 4. As illustrated in FIG. 4, the manual feed tray 42 includes the cover member 3, a sheet feeding platform 43, and the extension guide 41. In the following, those components are described with reference to FIGS. 5 through 7.

The cover member 3 is described with reference to FIG. 5. As illustrated in FIG. 5, the cover member 3 includes an engagement recess 44, a forward end wall 45, and guide plates 46.

The engagement recess 44 is integrally formed with the cover member 3 near the center of the width of the forward end side (upper end side) of the surface 3*c* of the cover member 3. The engagement recess 44 engages the cover member 3 to the front cover 2.

The forward end wall 45 extends across the cover member 3. The height of the forward end wall 45, as measured from the surface 3*c* of the cover member 3, is smaller than the height of the guide plates 46.

The guide plates 46 extend integrally with both side end portions of the cover member 3. Each guide plate includes a cover member support shaft 13, a sheet feeding platform guide groove 48, and an extension-guide guide groove 50. In the following, the cover member support shaft 13, the sheet feeding platform guide groove 48, and the extension-guide guide groove 50 of the guide plate 46 extending on the left-hand side end of the cover member 3 are described. The cover member support shaft 13 is formed integrally with the proximal end side 3*a* of the guide plate 46 (The proximal end means the end portion on the opposite side of the distal (other) end with respect to the longitudinal direction). The cover member 3 is supported at the proximal end side (lower end side) 3*a* by the cover member support shaft 13 so as to be pivotable with respect to the main body 4. The cover member 3 can be placed in the storage position A1 (position indicated by the solid line of FIG. 2) wherein the cover member 3 covers the recess 11 of the front cover 2 and the sheet feeding position A2 (position indicated by the double-dashed line of FIG. 2) in which the cover member 3 is pivoted.

The sheet feeding platform guide groove 48 includes a sheet feeding platform proximal end side guide groove 51 for guiding a proximal end side 43*a* of the sheet feeding platform 43 (see FIG. 6) and a sheet feeding platform distal end guide groove 52 for guiding a distal end side 43*b* of the sheet feeding platform 43.

In the sheet feeding position A2, the sheet feeding platform proximal end side guide groove 51 is an elongated hole gently curved so as to be downwardly convex. The sheet feeding platform proximal end side guide groove 51 is formed so as to extend from the proximal end side 3*a* of the guide plate 46 to a portion near the center in the longitudinal direction of the guide plate 46 and penetrates the guide plate 46. In the sheet feeding position A2, the sheet feeding platform distal end guide groove 52 is an elongated hole gently curved so as to be upwardly convex. The sheet feeding platform distal end guide groove 52 extends at a portion near the center in the longitudinal direction of the guide plate 46 and extends through the guide plate 46. The extension-guide guide groove 50 is an elongated hole. In the sheet feeding position A2, the proximal end 50*a* of the extension-guide guide groove 50 is located below the proximal end 52*a* of the sheet feeding platform distal end guide groove 52. In the sheet feeding position A2, the distal end 50*b* thereof is located below a portion, generally in the center, of the sheet feeding platform distal end guide groove 52. The extension-guide guide groove 50 is formed of a portion extending along the lower end of the guide plate 46 from the proximal end 50*a* up to a portion, generally in the center of the extension-guide guide groove 52, and a portion extending from the portion mentioned above along the sheet feeding platform distal end guide groove 52. The distal end 52*b* of the sheet feeding platform distal end guide groove 52 and the distal end 50*b* of the extension-guide guide groove 50 are of the same height as measured from the surface 3*c* of the cover member 3. The proximal end 50*a* of the extension-guide guide groove 50 is in close proximity to the surface 3*c* of the cover member 3. Like the guide plate provided at the left-hand end, the guide plate 46 provided at the right-hand end has the cover member support shaft 13, the sheet feeding platform guide groove 48, and the extension-guide guide groove 50 at positions corresponding to those of the guide plate 46 provided at the left-hand end.

The sheet feeding platform 43 is described with reference to FIG. 6. As illustrated in FIG. 6, the sheet feeding platform 43 has at the upper end surface thereof the sheet stacking surface 43*c*, and substantially chevron-shaped side plates 53 are formed integrally therewith at both sides thereof.

When the cover member 3 is in the sheet feeding position A2, the sheet stacking surface 43*c* forms a stacking surface that defines the stacking surface on the front end with respect to the sheet feeding direction.

The side plate 53 on the left-hand side of the sheet feeding platform 43 has a hook-shaped protrusion 54 and a sheet feeding platform support protrusion 55 formed integrally therewith. The hook-shaped protrusion 54 is formed integrally with the upper portion of the side plate 53, and its forward end is formed in a hook-like configuration. The sheet feeding platform support protrusion 55 includes a sheet feeding platform proximal end side support protrusion 56 supporting the proximal end side 43*a* of the sheet feeding platform 43 and a sheet feeding platform distal end side support protrusion 57 supporting the distal end side 43*b* of the sheet feeding platform 43. The sheet feeding platform distal end support protrusion 57 is formed integrally with the side plate 53 at the distal end side of the side plate 53 of the sheet feeding platform 43, and the sheet feeding platform proximal end side support protrusion 56 is formed integrally with side plate 53 at the lower end of the side plate 53 below the hook-shaped protrusion 54. Similarly, the side plate 53 on the right-hand side of the sheet feeding platform 43 has a hook-shaped protrusion 54, the sheet feeding platform proximal end side support protrusion 56, and the sheet feeding platform distal end side support protrusion 57 at positions corresponding to those of the side plate 53 on the left-hand side.

Further, because the sheet feeding platform proximal end side support protrusions 56 are loosely fitted into the sheet feeding platform proximal end side guide grooves 51 described above and the sheet feeding platform distal end side support protrusions 57 are loosely fitted into the sheet feeding platform distal end guide grooves 52 described above, the sheet feeding platform 43 can move forward and back while maintaining a gap between itself and the surface 3*c* of the cover member 3.

Here, as described above, in the sheet feeding position A2, the sheet feeding platform proximal end side guide grooves 51 formed in the guide plates 46 of the cover member 3 are gently curved so as to have a downwardly convex. Further, in the sheet feeding position A2, the sheet feeding platform distal end guide grooves 52 are gently curved so as to have an upwardly convex. Thus, when the sheet feeding platform 43 slides in the longitudinal direction of the cover member 3, the back surface 43*d* of the sheet feeding platform 43 slides while the angle of incline with respect to the surface 3*c* of the cover member 3 is changed.

When the manual feed tray 42 is in sheet feeding position A2, the sheet feeding platform proximal end side support protrusions 56 are located at the proximal ends 51*a* of the sheet feeding platform proximal end side guide grooves 51, and the sheet feeding platform distal end side support protrusions 57 are located at the proximal ends 52*a* of the sheet feeding platform distal end guide grooves 52 (see FIG. 10). FIGS. 10 through 14 describe when the manual feed tray 42 is moved from the sheet feeding position A2 to position A1.

When the sheet feeding platform proximal end side support protrusions 56 and the sheet feeding platform distal end side support protrusions 57 slide along the sheet feeding platform guide grooves 48 toward the distal end side 3*b* of the cover member 3, the back surface 43*d* of the sheet feeding platform 43 is inclined such that the back surface 43*d* is spaced apart from the surface 3*c* of the cover member 3 on the distal end side 43*b* and in close proximity thereto on the proximal end side 43*a*. Further, near the center in the longitudinal direction of the sheet feeding platform guide grooves 48, the angle of incline of the back surface 43*d* of the sheet feeding platform 43 with respect to the cover member 3 is its greatest. Near the center, in a longitudinal direction of the sheet feeding platform guide grooves 48, the curvature of the sheet feeding platform guide grooves 48 is small, and hence the sheet feeding platform 43 slides while substantially maintaining an incline. Further, after the sheet feeding platform proximal end side support protrusions 56 and the sheet feeding platform distal end side support protrusions 57 have passed the position near the longitudinal center of the sheet feeding platform guide grooves 48, the back surface 43*d* of the sheet feeding platform 43 slides so as to be close to the surface 3*c* of the cover member 3 on the distal end 43*b* side and spaced apart therefrom on the proximal end 43*a* side. When the sheet feeding platform proximal end side support protrusions 56 and the sheet feeding platform distal end side support protrusions 57 slide toward the distal end side of the sheet feeding platform guide grooves 48, the back surface 43*d* of the sheet feeding platform 43 is substantially parallel to the surface 3*c* of the cover member 3. The sheet feeding platform 43 assumes this position when the cover member 3 is in position A1.

The extension guide 41 will now be described with reference to FIGS. 7A and 7B. As illustrated in FIGS. 7A and 7B, the extension guide 41 has a substantially rectangular shape and includes extension guide support protrusions 58 (extension member support protrusions), an opening 60 that can be grasped, semi-circular plate protrusions 61, and hooking portions 62 (locking protrusions).

When the manual feed tray 42 is used, the upper surface side of the extension guide 41 defines the sheet support surface 41*c*. When the cover member 3 is in the sheet feeding position A2, the upper surface side of the extension guide 41 defines a rear end side support surface with respect to the sheet feeding direction.

The pair of extension guide support protrusions 58 are formed integrally with the extension guide 41 on the side surfaces of the extension guide 41 between the proximal end 41*a* side and the longitudinal center of the side surfaces of the extension guide 41. When the extension guide 41 is mounted to the cover member 3, the extension guide support protrusions 58 are loosely received in the extension-guide guide grooves 50 of the cover member 3. The extension guide support protrusions 58 slide within the extension-guide guide grooves 50, whereby the extension guide 41 can be pulled out in a direction longitudinal to the cover member 3. When the extension guide support protrusions 58 are positioned at the proximal ends 50*a* of the extension-guide guide grooves 50, the extension guide 41 is in the storage position, and when the extension guide support protrusions 58 are located at the distal ends 50*b* of the extension-guide guide grooves 50, the extension guide 41 assumes the pulled-out position.

The opening 60 is located near the center of the distal end side of the extension guide 41 so as to penetrate the extension guide 41. When pulling out the extension guide 41 to the pulled-out position, the operator can grasp the opening 60. Further, the opening 60 also functions as an opening through which an engagement protrusion 64 (see FIG. 8) located on the front cover 2, described below, passes.

The pair of semi-circular plate protrusions 61 are extended from and are integral with the extension guide 41. When a sheet, having a length in the sheet feeding direction greater than the length between the distal end 41*b* of the extension guide 41 and the proximal end 43*a* of the sheet feeding platform 43, is placed on the sheet supporting surface 41*c*, the sheet is retained with its proximal end portion in the sheet feeding direction, being held by the semi-circular plate protrusions 61, while being upwardly biased due to its stiffness. Thus, it is possible to prevent the sheet from drooping and falling from the sheet supporting surface 41*c*.

The hooking portions 62 have a triangular sectional configuration. A pair of the hooking portions 62 extend from and are integral near the distal end 41*b* of the back surface 41*d* of the extension guide 41. Due to the triangular sectional configuration thereof, the inclined surfaces 62*a* of the hooking portions 62 are brought into sliding contact with the upper end edge 45*a* of the distal end wall 45 of the cover member 3 when the extension guide 41 is pulled out. Further, immediately before the hooking portions 62 reach the pulled-out position, the triangular inclined surfaces 62*a* move over the upper end edge 45*a* of the distal end wall 45, and vertical surfaces 62*b* of the hooking portions 62 are located on the side surface 45*b* of the distal end wall 45 (see FIG. 13). As a result, the extension guide 41 is retained in the pulled-out position. Here, the extension guide 41 is retained on the cover member 3 by a pair of extension guide support protrusions 58 and the hooking portions 62 formed so as to be spaced from each other in a direction from the proximal end 41*a* toward the distal end 41*b*. Hence, when an external force that moves the proximal end side 41*a* of the extension guide 41 close to the surface 3*c* of the cover member 3 add to the extension guide 41, the distal end 41*b* of the extension guide 41 pivots so as to move away from the surface 3*c* of the cover member 3 around the extension guide support protrusions 58. That is, the hooking portions 62 move away from the distal end wall 45 of the cover member 3.

(Relationship between Front Cover and Manual Feed Tray)

As illustrated in FIG. 8, the manual feed tray 42 is pivotally supported at the proximal end. Further, the manual feed tray 42 is connected to connection members (link levers) 63 (connection members) pivotally supported at a predetermined position of the front cover 2. Further, as illustrated in FIG. 9, in the recess 11 of the front cover 2, there is located the engagement protrusion 64 allowing a mutual detachable engagement with an engagement recess 44 formed in the cover member 3.

The connection members 63 will be described with reference to FIGS. 8A through 8D. In FIG. 8A, the manual feed tray 42 is in the sheet feeding position A2. FIG. 8B is an enlarged view of the left-hand side connection member 63 when the manual feed tray 42 is in the sheet feeding position A2. FIG. 8C is an enlarged view of the right-hand side connection member 63 when the manual feed tray 42 is in the sheet feeding position A2. FIG. 8D is an enlarged view of the left-hand side connection member 63 as detached from the front cover 2 and the sheet feeding platform 43.

Of the right-hand and left-hand side connection members 63, the left-hand side connection member 63 is illustrated in FIG. 8D. The link lever 63 has an arm-like configuration, and a proximal end portion 63*a* thereof is pivotally supported by the front cover 2. At the distal end portion 63*b* of the connection member 63, there is formed an elongated hole 65 extending in the longitudinal direction of the connection member 63. The hook-like protrusion 54 formed on the side plate 53 of the sheet feeding platform 43 described above is loosely received into the elongated hole 65 of the connection member 63. Because the connection member 63 is connected to the sheet feeding platform 43 mounted to the cover member 3, the sheet feeding platform 43 can be moved forward and back in a direction longitudinal to the cover member 3 with the opening/closing of the cover member 3. Further, because the connection member 63 is mounted to the sheet feeding platform 43 of the manual feed tray 42, the angle of the manual feed tray 42 with respect to the front cover 2 is restricted, and hence the manual feed tray 42 can be located in the sheet feeding position A2.

Next, engagement/disengagement of the front cover 2 and the cover member 3 will be described with reference to FIG. 9. At the upper portion of the recess 11 of the front cover 2, there is located the engagement protrusion 64 allowing mutual engagement/disengagement of the front cover 2 and the cover member 3. When the cover member 3 is positioned in the storage position A1 with respect to the front cover 2, the engagement protrusion 64 located on the front cover 2 and the engagement recess 44 formed in the cover member 3, described above, are mutually engaged with each other to elastically retain the cover member 3 in the storage position A1. The engagement protrusion 64 and the engagement recess 44 can be, for example, a push latch. Here, the cover member 3 is in position A1, when the extension guide 41 is in the storage position (within the gap between the sheet feeding platform 43 and the cover member 3), the extension guide 41 covers the engagement recess 44 formed in the cover member 3 (see FIG. 14). Because the opening 60 is formed in the extension guide 41, the engagement protrusion 64 passes through the opening 60, whereby the engagement protrusion 64 can be mutually engaged with the engagement recess 44 formed in the cover member 3. When the front cover 2 is opened and closed, with the front cover 2 and the cover member 3 being elastically engaged with each other, the cover member 3 is maintained in position A1. On the other hand, when the operator pulls out the distal end side 3*b* of the cover member 3 located in position A1, the engagement of the engagement recess 44 and the engagement protrusion 64 is released, and the cover member 3 can assume the sheet feeding position A2.

The operation of opening the cover member 3 will now be described. First, the pulling out the cover member 3 until the cover member 3 assumes the sheet feeding position A2 will be described. When the operation of opening the cover member 3 is started, the hook-like protrusions 54 of the sheet feeding platform 43 move along the elongated holes 65 of the connection members 63, and the connection members 63 are pivoted, causing the hook-like protrusions 54 to abut the distal ends 65*a* of the elongated holes 65. When the hook-like protrusions 54 abut the distal ends 65*a* of the elongated holes 65, a tensile force in the longitudinal direction of the cover member 3 is applied to the sheet feeding platform 43 from the connection members 63.

Then, as the connection members 63 are pivoted, the sheet feeding platform proximal end side support protrusions 56 slide from the distal ends 51*b* to the proximal ends 51*a* of the sheet feeding platform proximal end side guide grooves 51, and at the same time, the sheet feeding platform distal end side support protrusions 57 slide from the distal ends 52*b* to the proximal ends 52*a* of the sheet feeding platform proximal end side guide grooves 52, causing the sheet feeding platform 43 to slide from the distal end side 3*b* to the proximal end side 3*a* of the cover member 3. When the cover member 3 is pulled out and the sheet feeding platform proximal end side support protrusions 56 abut the proximal ends 51*a* of the sheet feeding platform proximal end side guide grooves 51 and/or the sheet feeding platform distal end side support protrusions 57 abut the proximal ends 52*a* of the sheet feeding platform distal end side guide grooves 52, the cover member 3 cannot be opened any further. At this time, the cover member 3 assumes the sheet feeding position A2. When the cover member 3 is in the sheet feeding position A2, the sheet feeding platform 43 defines the supporting surface for the sheet leading ends. Further, when the operator grasps the opening 60 to pull the extension guide 41 to the pulled-out position, and the hooking portions 62 formed on the back surface 41*d* of the extension guide 41 are hooked on the side surface 45*b* of the distal end wall 45 of the cover member 3, the extension guide 41 is supported by the cover member 3 to define the supporting surface for the end of the sheets. As a result, the manual feed tray 42 is in the sheet feeding position A2 illustrated in FIG. 10. At this time, the distal end side 43*b* of the sheet feeding platform 43 and the proximal end side 41*a* of the extension guide 41 are brought into contact with each other, and the sheet supporting surface 43*c* of the distal end side portion 43*b* of the sheet feeding platform 43 and the sheet supporting surface 41*c* of the proximal end side portion 41*a* of the extension guide 41 become substantially flat with respect to each other. Thus, when feeding sheets by the manual feed tray 42, it is possible to easily feed sheets.

(Extension Guide Accommodation Operation)

When the cover member 3 is pivoted from the sheet feeding position A2 to the storage position A1, the sheet feeding platform 43 pivots the extension guide 41. In this embodiment, the image forming apparatus 1 includes the extension member lock releasing mechanism which releases the locked status of the hooking portions 62 of the extension guide 41 and the distal end wall 45 of the cover member 3. The extension guide 41 can then be stored in the storage position, due to its own weight, through the storage operation of the manual feed tray 42. Here, the extension member lock releasing mechanism is formed of the connection members 63 described above, the sheet feeding platform 43 connected to the connection members 63, the sheet feeding platform support protrusions 55 formed on the sheet feeding platform 43, and the sheet feeding platform guide grooves 48.

FIG. 10 is a sectional view of the manual feed tray 42 when the manual feed tray 42 is in the sheet feeding position A2. When the cover member 3 is pivoted in the closing direction from the sheet feeding position illustrated in FIG. 10, the connection members 63 are pivoted around the support portion which is positioned in the front cover 2 and supports the connection members 63 as a pivoting fulcrum 66, through interlock with the movement. When the connection members 63 are pivoted, the sheet feeding platform 43 moves toward the distal end side 3*b* of the cover member 3 along the sheet feeding platform guide grooves 48. As described above, with this movement, the sheet feeding platform 43 slides, such that the distal end side 43*b* thereof is spaced apart from the surface 3*c* of the cover member 3, and that the proximal end side 43*a* thereof is brought close to the surface 3*c* of the cover member 3. Further, while closing the cover member 3, the back surface 43*d* of the sheet feeding platform 43 moves into contact with the proximal end side 41*a* of the extension guide 41.

FIG. 11 is a sectional view of the manual feed tray 42 when the back surface 43*d* of the sheet feeding platform 43 contacts with the proximal end portion 41*a* of the extension guide 41. After the back surface 43*d* of the sheet feeding platform 43 and the proximal end 41*a* of the extension guide 41 are brought into contact with each other, the sheet feeding platform 43 slides toward the distal end side 3*b* of the cover member 3 while substantially maintaining the above-mentioned position. Then, as the sheet feeding platform 43 slides such that the distal end side 43*b* of the sheet feeding platform 43 is brought close to the surface 3*c* of the cover member 3, the proximal end side 41*a* of the extension guide 41 pivots to the direction of the surface 3*c* of the cover member 3, and comes close to the surface 3*c* of the cover member 3. That is, using the extension guide support protrusions 58 as a pivoting fulcrum point, the extension guide 41 is pivoted such that the distal end portion 41*b* of the extension guide 41 moves away from the upper end edge 45*a* of the distal end wall 45 of the cover member 3 (see FIG. 13). As a result, the hooking portions 62 of the extension guide 41 are detached from the distal end wall 45 of the cover member 3. FIG. 12 is a sectional view of the manual feed tray 42 at the moment when the hooking portions 62 of the extension guide 41 are released from the distal end wall 45 of the cover member 3. In FIG. 13, the solid line indicates the moment when the back surface 43*d* of the sheet feeding platform 43 and the proximal end side 41*a* of the extension guide 41 are brought into contact with each other. The double-dashed line schematically illustrates how the sheet feeding platform 43 advances while substantially maintaining an inclined position to cause the proximal end side 41*a* of the extension guide 41 to slide on the back surface 43*d* of the sheet feeding platform 43, with the hooking portions 62 being detached from the distal end wall 45.

When the hooking portions 62 of the extension guide 41 are detached from the distal end wall 45 of the cover member 3, the cover member 3 is almost upright. Thus, the extension guide support protrusions 58 freely fall along the extension-guide guide grooves 50, and the extension guide 41 is stored in the gap between the sheet feeding platform 43 and the cover member 3.

Here, pursuant to the present invention, the extension guide support protrusions 58 slide along the extension-guide guide grooves 50, and hence, as compared with the construction of the second conventional technology in which the guide rib 115 is fitted into the guide rail 113 (see FIG. 20), the contact area is smaller. Thus, the frictional resistance involved is less, and when the hooking portions 62 are released from the distal end wall 45 of the cover member 3 during the operation of storing the manual feed tray 42, the extension guide can be more easily stored due to its own weight as compared with a structure in which the guide rib 115 is fitted into the guide rail 113.

After this, the sheet feeding platform 43 slides toward the distal end side 3*b* of the cover member 3 along the sheet feeding platform guide grooves 48. When the cover member 3 is in the storage position A1, the back surface 43*d* of the sheet feeding platform 43 becomes substantially parallel to the surface 3*c* of the cover member 3. Thus, it is possible to achieve space saving in terms of storage space of the manual feed tray 42. FIG. 14 is a sectional view illustrating the manual feed tray 42 storing in storage position A1.

As described above, the image forming apparatus 1, in an embodiment, has a mechanism which automatically releases the retention state of the extension guide 41 through interlock with the operation by which the manual feed tray 42 is stored in the main body 4 from the sheet feeding position A2. Thus, in the course of the operation of storing the manual feed tray 42, the retention of the extension guide 41 with respect to the cover member 3 is released, and the extension guide 41 falls due to its own weight to be moved to the storage position. As a result, the front cover 2 and the sheet stacking surface 41*c* of the extension guide 41 cannot abut each other because of the extension guide 41 being left unstored, thus preventing damage of the front cover 2 and the sheet support surface 41*c* of the extension guide 41. Further, because the extension guide 41 is stored through an interlocking with the operation of storing the manual feed tray 42, it is possible to eliminate the need to store the extension guide 41 each time the manual feed tray 42 is stored.

In an embodiment, the sheet feeding platform guide grooves 48 defining the extension member lock releasing mechanism include the sheet feeding platform proximal end guide grooves 51 are downwardly convex and the sheet feeding platform distal end guide grooves 52 are upwardly convex, however, the present invention is not limited thereto. Accordingly, any other construction may be used as long as, in the process in which the cover member 3 is pivoted from the sheet feeding position A2 to the storage position A1, it is possible to pivot the extension guide 41 as the extension member by the sheet feeding platform 43, and to release the lock state (hooked state) of the hooking portions 62 of the extension guide 41 and the distal end wall 45 of the cover member 3, thereby allowing the extension guide 41 to fall due to its own weight and be stored between the sheet feeding platform 43 and the cover member 3. For example, the sheet feeding platform guide groove 48 may be parallel to the surface 3*a* of the cover member 3. That is, even when the back surface 43*d* of the sheet feeding platform 43 moves parallel to the surface 3*c* of the cover member 3, it is possible to pivot the extension guide 41 through abutment of the distal end side 43*b* of sheet feeding platform 43 against the proximal end side 41*a* of the extension guide 41 so as to release the retention of the extension guide 41 at the pulled-out position through interlock with the storing operation of the manual feed tray 42 when, as illustrated in FIG. 15, the proximal end side 41*a* of the extension guide 41 gently inclines extending from the back surface 41*d* to the front surface 41*c* of the extension guide 41 (inclined surface obliquely cutting the extension guide 41 up from the back surface side to the front surface side), or when the distal end side 43*b* of the sheet feeding platform 43 gently inclines extending from the back surface 43*d* to the front surface 43*c* (inclined surface obliquely cutting the sheet feeding platform down from the front surface side to the back surface side).

As illustrated in FIG. 15, because the proximal end side 41*a* of the extension guide 41 has a gently inclined surface extending from the back surface 41*d* to the front surface 41*c*, a force is applied to the extension guide 41 at the time of abutment against the sheet feeding platform 43, thereby facilitating the pivoting of the extension guide 41.

Further, as illustrated in FIG. 15, by forming the distal end side 43*b* of the sheet feeding platform 43 so as to have gently inclined surface extending from the back surface 43*d* to the front surface 43*c*, a force is applied to the extension guide 41 at the time of abutment against the extension guide 41, thereby facilitating the pivoting of the extension guide 41.

Although, in the embodiment described above the sheet feeding platform 43 and the extension guide 41 are directly brought into contact with each other, the invention is not limited thereto. Any other structure may be used as long as it is also possible, in the process of pivoting cover member 3 from the sheet feeding position A2 to the storage position A1, to pivot the extension guide 41 as the extension member by the sheet feeding platform 43, and to release the lock state (hooked state) of the hooking portions 62 of the extension guide 41 and the distal end wall 45 of the cover member 3, thereby allowing the extension guide 41 to fall due to its own weight and be stored between the sheet feeding platform 43 and the cover member 3. For example, it is also possible to position a third member on the sheet feeding platform 43, and to bring the third member into contact with the extension guide 41.

The present invention is applicable to a variety of image forming apparatus including those having a manual feed tray which is supported by an openable/closable cover member covering a side surface of the main body and which is used by pulling out an extension tray.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A manual feed tray comprising:

a cover member pivotally supported at a lower end and having a storage position and a sheet feeding position;

a sheet feeding platform located at the lower end side of the cover member in the sheet feeding position, and mounted to the cover member that is so constructed and arranged as to slide toward an upper end side of the cover member and to leave a gap between the sheet feeding platform and itself;

an extension member which when stored is located in a gap between the sheet feeding platform and the cover member and when in a pulled-out position, a locking protrusion formed on the back surface on a distal end side of the extension member is hooked on an end edge of the upper end side of the cover member, and is pivotally retained so as to move away from the cover member, and when the cover member is pivoted from the sheet feeding position to the storage position, the sheet feeding platform is moved to the upper end side of the cover member by an extension member lock releasing mechanism interlocked with the pivoting of the cover member, pivots the extension member, and separates the locking protrusion of the extension member from the end edge of the upper end side of the cover member, with the extension member moving into the gap between the cover member and the sheet feeding platform so as to be stored therein.

2. A manual feed tray according to claim 1, wherein the extension member lock releasing mechanism comprises a connection member pivotally supporting the sheet feeding platform, the sheet feeding platform connected to the connection member, sheet feeding platform support protrusions respectively formed on both side surfaces of the sheet feeding platform, and a sheet feeding platform guide groove of the cover member slidably guiding the sheet feeding platform support protrusions.

3. A manual feed tray according to claim 1, wherein the extension member has extension member support protrusions on both side surfaces, the extension member support protrusions being slidable along extension member guide grooves formed in the cover member, the extension member being pivotally supported with respect to the cover member at distal end side end portions of the extension member guide grooves in the pulled-out position, and in the process in which the cover member is pivoted from the sheet feeding position to the storage position, the sheet feeding platform is moved to the upper end side of the cover member by the extension member lock releasing mechanism interlocked with the pivoting of the cover member and abuts the proximal end side of the extension member, pivots the extension member using the extension member support protrusions as a fulcrum point, and separates the locking protrusions of the extension member from the end edge of the upper end side of the cover member.

4. A manual feed tray according to claim 2, wherein the extension member has extension member support protrusions on both side surfaces, the extension member support protrusions being slidable along extension member guide grooves formed in the cover member, the extension member being pivotally supported with respect to the cover member at distal end side end portions of the extension member guide grooves in the pulled-out position, and wherein, in the process in which the cover member is pivoted from the sheet feeding position to the storage position, the sheet feeding platform is moved to the upper end side of the cover member by the extension member lock releasing mechanism interlocked with the pivoting of the cover member and abuts the proximal end side of the extension member, pivots the extension member using the extension member support protrusions as a fulcrum point, and separates the locking protrusions of the extension member from the end edge of the upper end side of the cover member.

5. A manual feed tray according to claim 2, wherein each of the sheet feeding platform support protrusions comprises sheet feeding platform distal end side support protrusions and sheet feeding platform proximal end side support protrusions, the sheet feeding platform guide grooves of the cover member is formed of sheet feeding platform proximal end side guide grooves slidably guiding the sheet feeding platform proximal end side support protrusions, and sheet feeding platform distal end side guide grooves slidably guiding the sheet feeding platform distal end side support protrusions.

6. A manual feed tray according to claim 5 wherein the sheet feeding platform proximal end side guide groove has a downwardly convex configuration and the sheet feeding platform distal end side guide groove has an upwardly convex configuration; and in the process of moving from the lower end side to the upper end side of the cover member, the sheet feeding platform moves, with the distal end side of the sheet feeding platform being raised higher than the proximal end side of the sheet feeding platform, the inclined back surface side thereof being in contact with the proximal end side of the extension member to pivot the extension member using the extension member support protrusion as a fulcrum point to separate the locking protrusion of the extension member from the end edge of the upper end side of the cover member.

7. A manual feed tray according to claim 3, wherein the proximal end side of the sheet feeding platform is an inclined surface.

8. A manual feed tray according to claim 3, wherein the portion of the sheet feeding table, which abuts the extension member, is an inclined surface.

9. A manual feed tray according to claim 5, wherein the sheet feeding platform proximal end side guide grooves and the sheet feeding platform distal end side guide grooves support the sheet feeding platform substantially parallel to the front surface of the cover member, with the cover member being in the storage position.

10. A manual feed tray according to claim 3, wherein, in the pulled-out position the extension member guide grooves support the extension member substantially parallel to the front surface of the cover member and support a sheet supporting surface of the extension member to be situated substantially in the same plane as that of a sheet supporting surface of the sheet feeding platform.

11. An image forming apparatus comprising:

a sheet accommodating portion for supporting sheets:

a sheet conveying potion conveys a sheet:

an image forming portion:

a discharge tray:

the sheet conveying potion comprises a sheet conveying path and a manual feed tray;

the manual feed tray comprising;

a cover member pivotally supported at a lower end and having a storage position and a sheet feeding position;

a sheet feeding platform located at the lower end side of the cover member in the sheet feeding position, and mounted to the cover member so as to be capable of sliding toward the upper end side of the cover member and so as to leave a gap between the sheet feeding platform and itself; and an extension member having a storage position in which the extension member is stored in the gap between the sheet feeding platform and the cover member and a pulled-out position wherein, in the pulled-out position, a locking protrusion formed on the back surface on a distal end side of the extension member is hooked on an end edge of the upper end side of the cover member, and is pivotally retained so as to move away from the cover member, and in the process in which the cover member is pivoted from the sheet feeding position to the storage position, the sheet feeding platform is moved to the upper end side of the cover member by an extension member lock releasing mechanism interlocked with the pivoting of the cover member, pivots the extension member, and separates the locking protrusion of the extension member from the end edge of the upper end side of the cover member, with the extension member moving into the gap between the cover member and the sheet feeding platform so as to be stored therein.

12. An image forming apparatus according to claim 11, wherein the extension member lock releasing mechanism comprises:

a connection member pivotally supports the sheet feeding platform;

the sheet feeding platform connected to the connection member;

sheet feeding platform support protrusions respectively formed on both side surfaces of the sheet feeding platform; and a sheet feeding platform guide groove of the cover member slidably guiding the sheet feeding platform support protrusions.

13. An image forming apparatus according to claim 11, wherein the extension member has extension member support protrusions on both side surfaces, the extension member support protrusions being slidable along extension member guide grooves formed in the cover member, the extension member being pivotally supported with respect to the cover member at distal end side end portions of the extension member guide grooves in the pulled-out position, and in the process in which the cover member is pivoted from the sheet feeding position to the storage position, the sheet feeding platform is moved to the upper end side of the cover member by the extension member lock releasing mechanism interlocked with the pivoting of the cover member and abuts the proximal end side of the extension member, pivots the extension member using the extension member support protrusions as a fulcrum point, and separates the locking protrusions of the extension member from the end edge of the upper end side of the cover member.

14. An image forming apparatus according to claim 12, wherein the extension member has extension member support protrusions on both side surfaces, the extension member support protrusions being slidable along extension member guide grooves formed in the cover member, the extension member being pivotally supported with respect to the cover member at distal end side end portions of the extension member guide grooves in the pulled-out position, and in the process in which the cover member is pivoted from the sheet feeding position to the storage position, the sheet feeding platform is moved to the upper end side of the cover member by the extension member lock releasing mechanism interlocked with the pivoting of the cover member and abuts the proximal end side of the extension member, pivots the extension member using the extension member support protrusions as a fulcrum point, and separates the locking protrusions of the extension member from the end edge of the upper end side of the cover member.

15. An image forming apparatus according to claim 12, wherein each of the sheet feeding platform support protrusions comprises sheet feeding platform distal end side support protrusions and sheet feeding platform proximal end side support protrusions, the sheet feeding platform guide grooves of the cover member is formed of sheet feeding platform proximal end side guide grooves slidably guiding the sheet feeding platform proximal end side support protrusions, and sheet feeding platform distal end side guide grooves slidably guiding the sheet feeding platform distal end side support protrusions.

16. An image forming apparatus according to claim 15 wherein the sheet feeding platform proximal end side guide grooves has a downwardly convex configuration and the sheet feeding table distal end side guide groove has an upwardly convex configuration, in the process of moving from the lower end side to the upper end side of the cover member, the sheet feeding platform moves, with the distal end side of the sheet feeding platform being raised higher than the proximal end side of the sheet feeding platform, the inclined back surface side thereof being in contact with the proximal end side of the extension member to pivot the extension member using the extension member support protrusion as a fulcrum point to separate the locking protrusion of the extension member from the end edge of the upper end side of the cover member.

17. An image forming apparatus according to claim 13, wherein the proximal end side of the sheet feeding platform is an inclined surface and/or the portion of the sheet feeding platform, which abuts the extension member, is an inclined surface.

18. An image forming apparatus according to claim 15, wherein the sheet feeding platform proximal end side guide grooves and the sheet feeding platform distal end side guide grooves support the sheet feeding platform substantially parallel to a front surface of the cover member, with the cover member being located in the storage position.

19. An image forming apparatus according to claim 13, wherein, in the pulled-out position the extension member guide grooves support the extension member substantially parallel to the front surface of the cover member and support a sheet stacking surface of the extension member to be situated substantially in the same plane as that of a sheet stacking surface of the sheet feeding stand.

20. A manual feed tray comprising:

a cover member having a storage position and a sheet feeding position;

a sheet feeding platform located at a lower end of the cover member in the sheet feeding position, and mounted to the cover member so as to slide toward an upper end side of the cover member and define a gap with the cover member;

an extension member that can be stored in the gap and can be pulled-out, wherein a locking protrusion formed on the back surface on a distal end side of the extension member hooks on an upper end side of the cover member, and is pivotally retained so as to move away from the cover member, and when the cover member is pivoted from the sheet feeding position to the storage position, the sheet feeding platform is moved to the upper end side of the cover member with the pivoting of the cover member, and separates the locking protrusion of the extension member from the end edge of the upper end side of the cover member, with the extension member moving into the gap.

* * * * *